US009696026B1

(12) United States Patent
Hardgrave

(10) Patent No.: US 9,696,026 B1
(45) Date of Patent: Jul. 4, 2017

(54) LIGHT FIXTURE WITH AIR HANDLER

(71) Applicant: Eric Neal Hardgrave, Keller, TX (US)

(72) Inventor: Eric Neal Hardgrave, Keller, TX (US)

( * ) Notice: Subject to any disclaimer, the term of this patent is extended or adjusted under 35 U.S.C. 154(b) by 0 days.

(21) Appl. No.: 14/052,766

(22) Filed: Oct. 13, 2013

Related U.S. Application Data

(63) Continuation of application No. 12/856,044, filed on Aug. 13, 2010, now abandoned, which is a continuation-in-part of application No. 11/378,209, filed on Mar. 16, 2006, now Pat. No. 7,819,563.

(60) Provisional application No. 60/663,479, filed on Mar. 16, 2005.

(51) Int. Cl.
*F21V 33/00* (2006.01)

(52) U.S. Cl.
CPC ..... *F21V 33/0096* (2013.01)

(58) Field of Classification Search
CPC ... F21S 8/065; F21V 33/0096; F21V 33/0092
USPC ..... 362/147, 96, 294, 406
See application file for complete search history.

(56) References Cited

U.S. PATENT DOCUMENTS

| | | | | |
|---|---|---|---|---|
| 2,130,802 | A * | 9/1938 | Kisling | 415/8 |
| 2004/0003724 | A1* | 1/2004 | Ellis | 96/115 |
| 2007/0247854 | A1* | 10/2007 | Lin | 362/294 |
| 2008/0291679 | A1* | 11/2008 | Barrett | F04D 25/12 362/294 |

* cited by examiner

*Primary Examiner* — Karabi Guharay

(57) ABSTRACT

A combination fan and light unit comprises a housing surrounding a coaxial fan disposed such that air impelled by the fan passes through the housing and is directed as desired by orienting the housing or by diffusers disposed across the air path. Disposed above and/or below the housing, a light optionally enclosed within a globe coupled to the housing also provides illumination from the fan light unit. Fan light units may be arrayed in various configurations, including single or multiple sconce arrays supported on walls, one or more pendant fan lights suspended from ceilings, satellite fan lights arrayed around a central body at the ends of radial arms to form a fan chandelier or in many other configurations to achieve both aesthetic lighting and directed air flow. The fan lights preferably have separate controls, and multiple units in a collective array such as a fan chandelier may be individually or collectively controllable. The fan light units may include heater strips to warm the air and filters to clean the air as it passes through the air handler.

33 Claims, 31 Drawing Sheets

LIGHT FIXTURE WITH AIR HANDLER

This application is a Continuation Application of application Ser. No. 12/856,044 filed on Aug. 13, 2010, which is a Continuation-In-Part of application Ser. No. 11/378,209 filed on Mar. 16, 2006, now issued as U.S. Pat. No. 7,819,563, which is a non-provisional application of Provisional Application Ser. No. 60/663,479 filed Mar. 16, 2005, all of which are hereby incorporated by reference to the maximum extent permitted by law.

BACKGROUND OF THE INVENTION

1. Field of the Invention

This invention relates generally to light fixtures, and particularly to light fixtures having built-in air handlers to provide both light and air movement in a single fixture. More particularly, this invention relates to a fan/light unit having one or more light sources and a shrouded air handler for dispersing both light and air movement within a selected area.

2. Description of Related Art

Chandeliers comprise decorative, sometimes exceptionally attractive lighting fixtures usually stationed in large gathering rooms such as entry vestibules or ballrooms. In residential settings, large chandeliers often grace living, dining and occasionally other rooms by hanging from the ceiling in the center of the room. Though very attractive and often quite efficient at lighting such rooms, chandeliers traditionally have no provision for circulating air within the rooms except for the relatively small amount of convection due to air warmed near the lights.

Ceiling fans likewise serve similar purposes to chandeliers. Typically mounted in the center of the room, ceiling fans comprise a central electric motor rotating a plurality of angled blades arrayed radially around the fan. Light fixtures affixed to the underside of the motor often provide optional, sometimes decorative lighting while the rotating blades create substantial air movement. Ceiling fans typically move air to cool a room, and provide no means for warming the air.

Ceiling fans usually are selected in lieu of chandeliers when air movement is desired and lighting is of secondary importance. Chandeliers, by contrast, usually are selected when attractive lighting is the primary motive, and air movement is secondary or provided by other means. A need exists for a fixture that may serve both motives simultaneously.

Air movement from the vicinity of lighting units can be important in other contexts, such as bathroom settings, where humidity can fog mirrors and windows despite the warmth of light sources nearby. Air movement also can be desirable in settings, such as hallways, where ceiling fans and chandeliers may be too large to be practical. A need exists for a lighting unit that includes an air handler for circulating cooling air or air warmed by the lighting unit to nearby surfaces or people.

Sconces are light fixtures mounted on walls, commonly spaced along corridors to provide lighting and points of interest therein. In such setting, sconces are disposed approximately three-fourths of the height of the wall and spaced along the corridor at approximately their height above the floor, sometimes alternating from one side to the other. Sconces usually are directed upward rather than downward, but in some cases, such as bathrooms, they may be directed downward. In all such cases, the ability also to create air movement with such sconces enhances the value of sconces.

Pendant lights have become popular in recent years, with fixtures depending by wires or other structures from high ceilings to dispose their light source within a preferred distance of a work surface or floor. Often stylish and decorative, pendant lights thus comprise a variation of chandeliers usually having a single light source, an array of such pendant lights being used to light a room or surface. Similarly to sconces, a need exists in some cases for pendant lights to include air handling means for stirring air in such contexts without the need for a separate device.

SUMMARY OF THE INVENTION

A combination fan and light unit comprises a housing surrounding a coaxial fan disposed such that air impelled by the fan passes through the housing and is directed as desired by orienting the housing or by diffusers disposed across the air path. Disposed above and/or below the housing, a light optionally surrounded by a globe coupled to the housing also provides illumination from the fan light unit. Fan light units may be arrayed in various configurations, including single or multiple sconce arrays supported on walls, one or more pendant fan lights suspended from ceilings, satellite fan lights arrayed around a central body at the ends of radial arms to form a fan chandelier or in many other configurations to achieve both aesthetic lighting and directed air flow. The fan lights preferably have separate controls, and multiple units in a collective array such as a fan chandelier may be individually or collectively controllable. The fan light units may include heater strips to warm the air and filters to clean the air as it passes through the air handler.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF PREFERRED EMBODIMENTS

Figure 1:
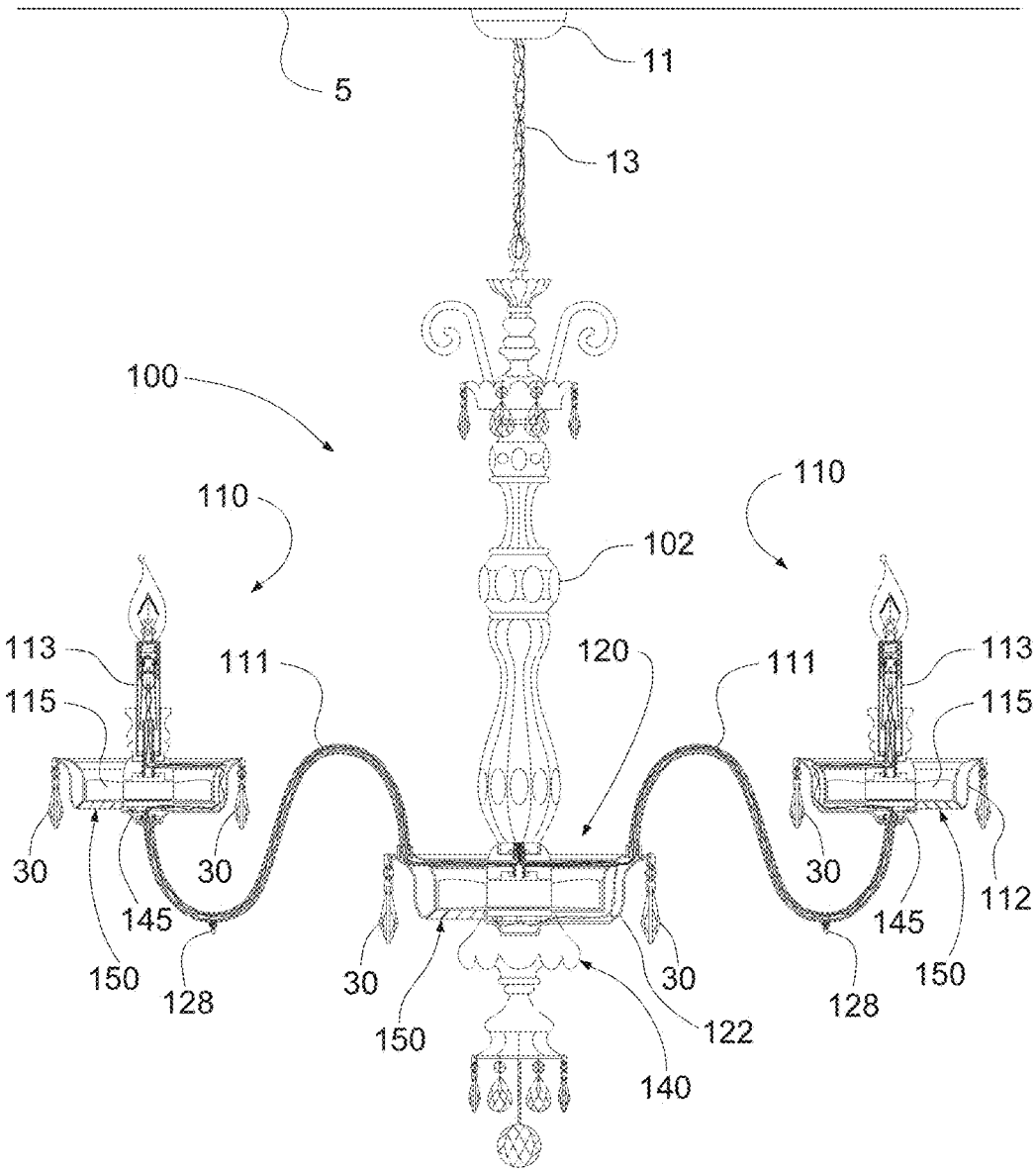
FIG. 1 depicts a preferred embodiment of the fan chandelier of the present invention having a central body and satellite light fixtures both bearing electrically driven fans.

With reference now to the figures, and in particular to FIGS. 1-5B, fan chandelier 100 comprises central body 102 depending from ceiling 5 at mount 11 by suspension means 13 (such as a chain or rigid mast). Disposed at the bottom of central body 102 opposite chain 13, central fan unit 120 includes shroud 122 encircling fan 125 and supporting the ends of arms 111 proximate central body 102. Base 140 depending from fan unit 120, discussed in more detail below, serves in part to disperse air flowing downward from fan 125.

Figure 4A:
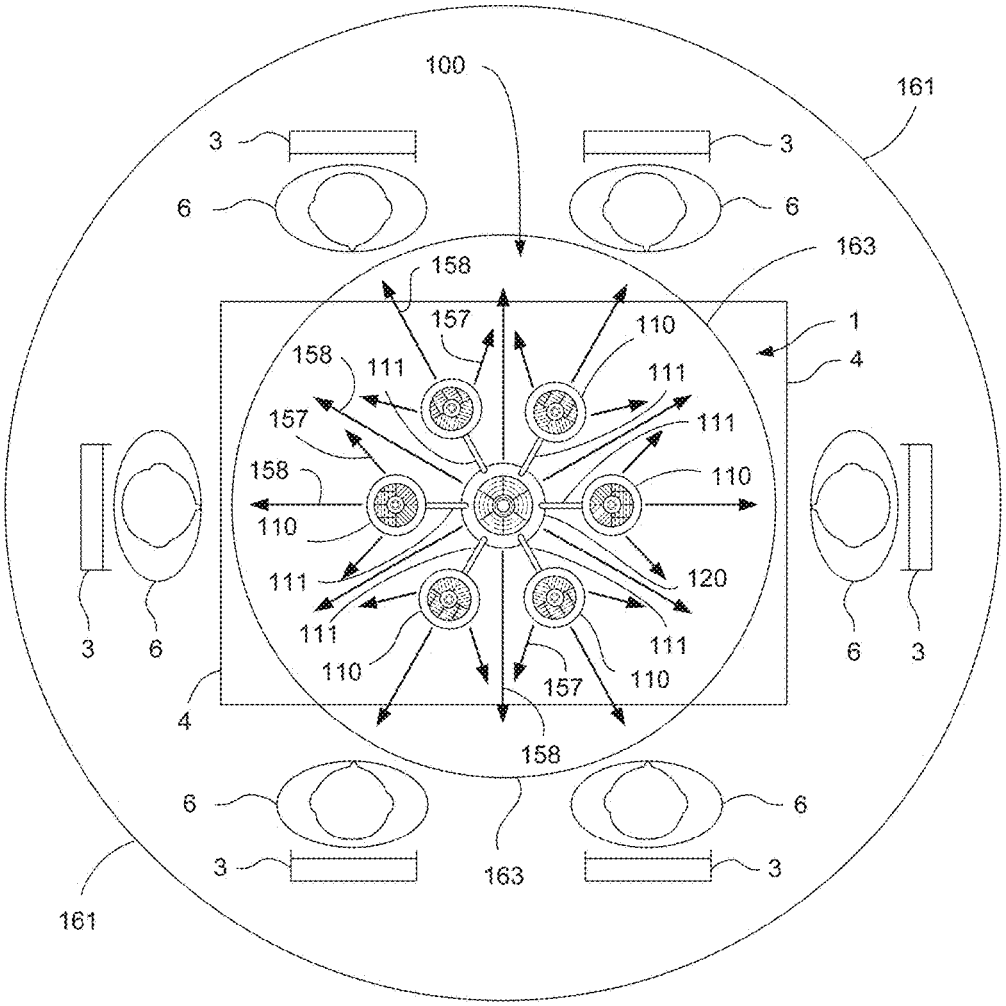
FIG. 4A shows a plan view of the chandelier fan of FIG. 1 suspended above a dining table with surrounding seating.

As seen best in FIG. 4A, fan chandelier 100 further comprises a plurality of satellite units 110 arrayed radially on arms 111 and evenly encircling central body 102 above dining table 1 and seating 3. Satellites 110 also may be disposed in more than one plane (fan chandelier 105 in FIG. 5A) and at different radial distances from central body 102. Each of satellites 110 is supported by base 145 or 146 disposed at the end of arm 111 opposite central body 102. Shroud 112 surrounds satellite fan 115 and supports light unit 113 disposed axially above base 145, 146.

Fan chandeliers 100, 105 suspend centrally above table 1 such that satellites 110 extend substantially evenly toward all sides of table 1 where seats 3 are disposed just beyond edge 4 thereof. Optimally, central body 102 reaches downward from ceiling 5 to within approximately thirty to thirty-four (30"-34") inches above the top of table 1, with satellites 110 extending horizontally therefrom to within approximately six (6") to twelve (12") inches inside perimeter 4 of table 1.

Fans 115, 125 spin in one or more horizontal planes to impel air vertically above table 1 within region of influence 161 (FIGS. 4A, 5A), while light units 113 provide illumination to table 1. Crystals 30 optionally disposed around central body 102 and satellites 110 refract and disperse light from light units 113 as expected of chandeliers generally. Fan chandeliers 100, 105 thus provide both aesthetically pleasing lighting to diners 6 seated around table 1 while simultaneously creating air movement within region 161, as discussed in more detail below.

Figure 2A:
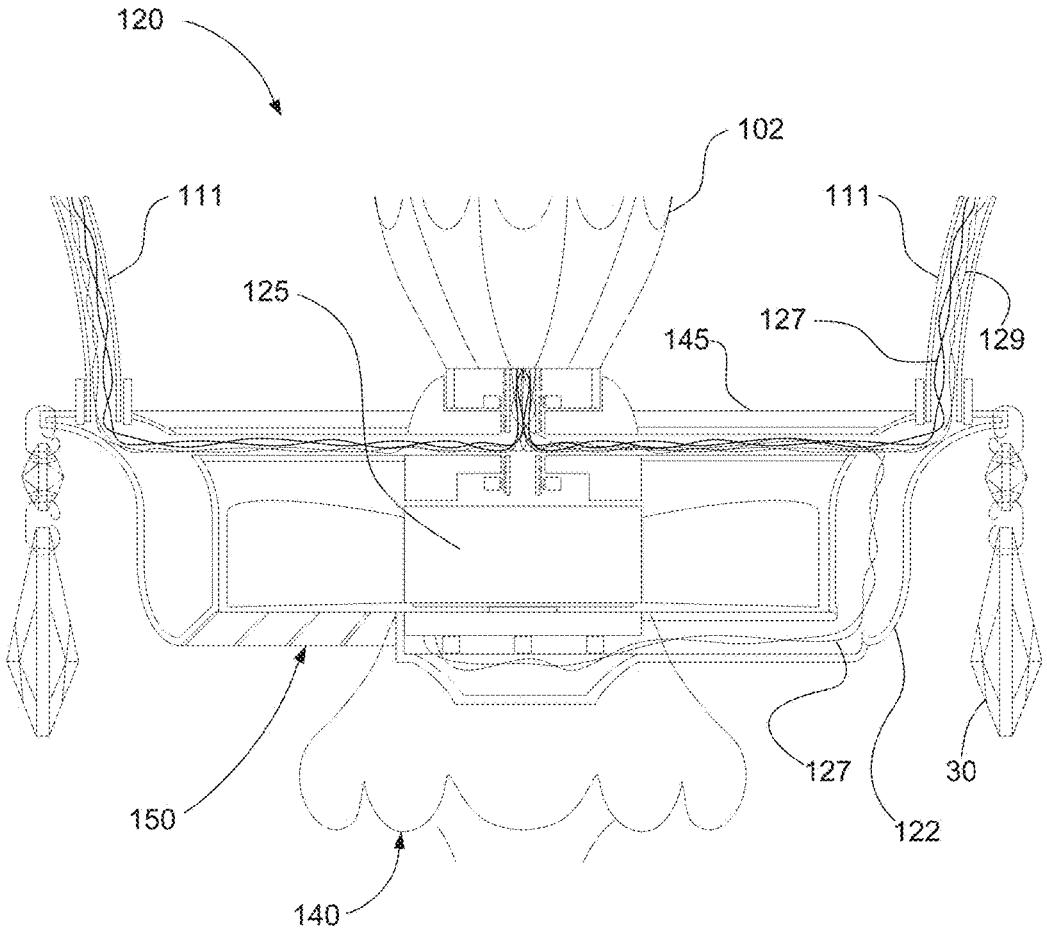
FIGS. 2A, 2B detail in partial cross sections alternative embodiments of fan units in the central body of the invention shown in FIG. 1.
Figure 2B:
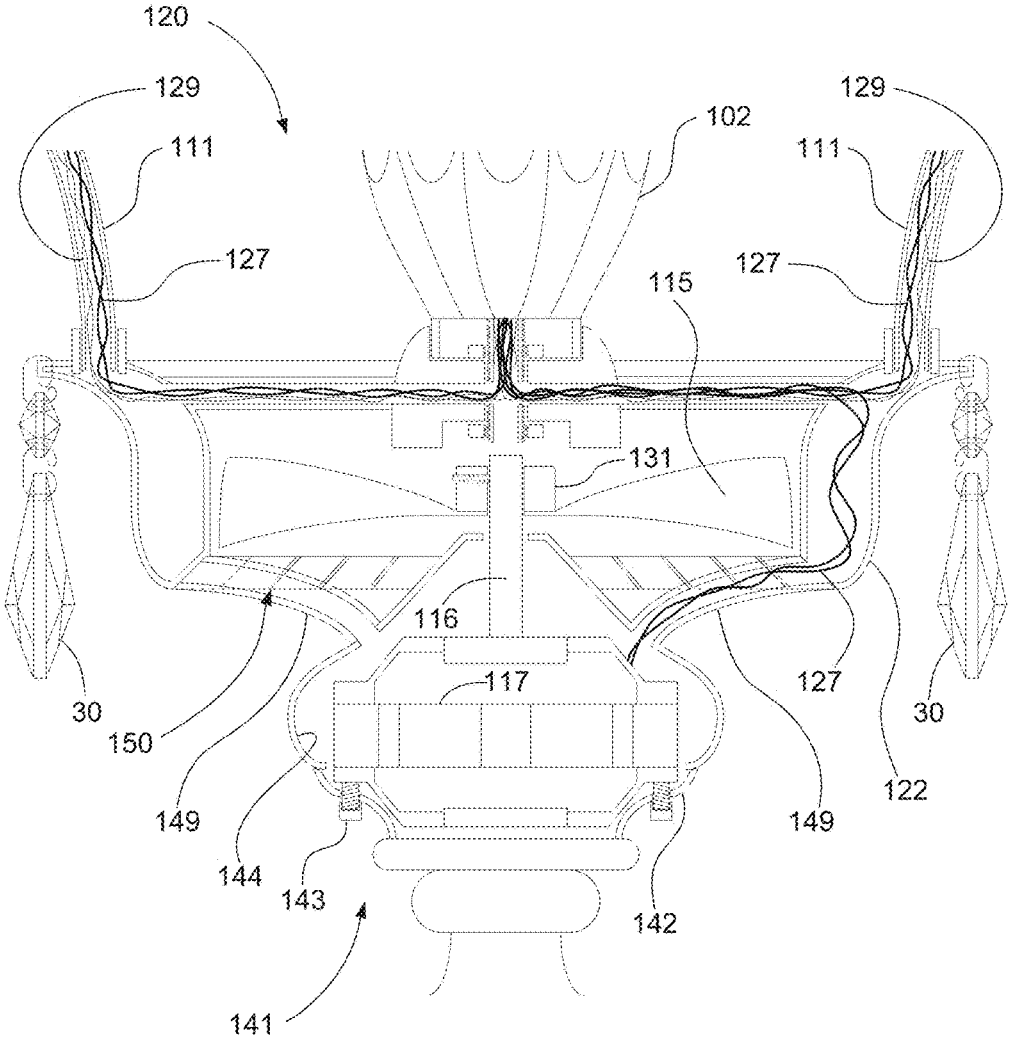

As best seen in FIG. 2A-2B, central fan unit 120 includes shroud 122 which supports the ends of arms 111 proximate central body 102. Shroud 122 comprises a substantially vertical, hollow cylinder adapted to channel air around central body 102 and base 140. Shroud 122 also surrounds central fan 125 which rotates in a horizontal plane and coaxial with central body 102. In the preferred embodiment of FIG. 2A, case style fan 125 includes motor 117 coplanar with the blades of fan 125, and base 140, if present at all, is largely decorative, but also serves to partially disperse air from fan 125.

As depicted in FIG. 2B, alternate base 141 comprises an enlarged, hollow, globular object suspended by wings 149 from shroud 122. Base 141 includes interior 144 which surrounds, encloses and conceals electric motor 117. Motor 117 is supported by motor mounts 143 within chamber 144 above belly 142, and shaft 116 extends upward through body 141 to couple to hub 131 of fan 125. At least one of wings 149 provides a hollow path for fan motor wiring 127 extending to motor 117 from central body 102.

Figure 3A:
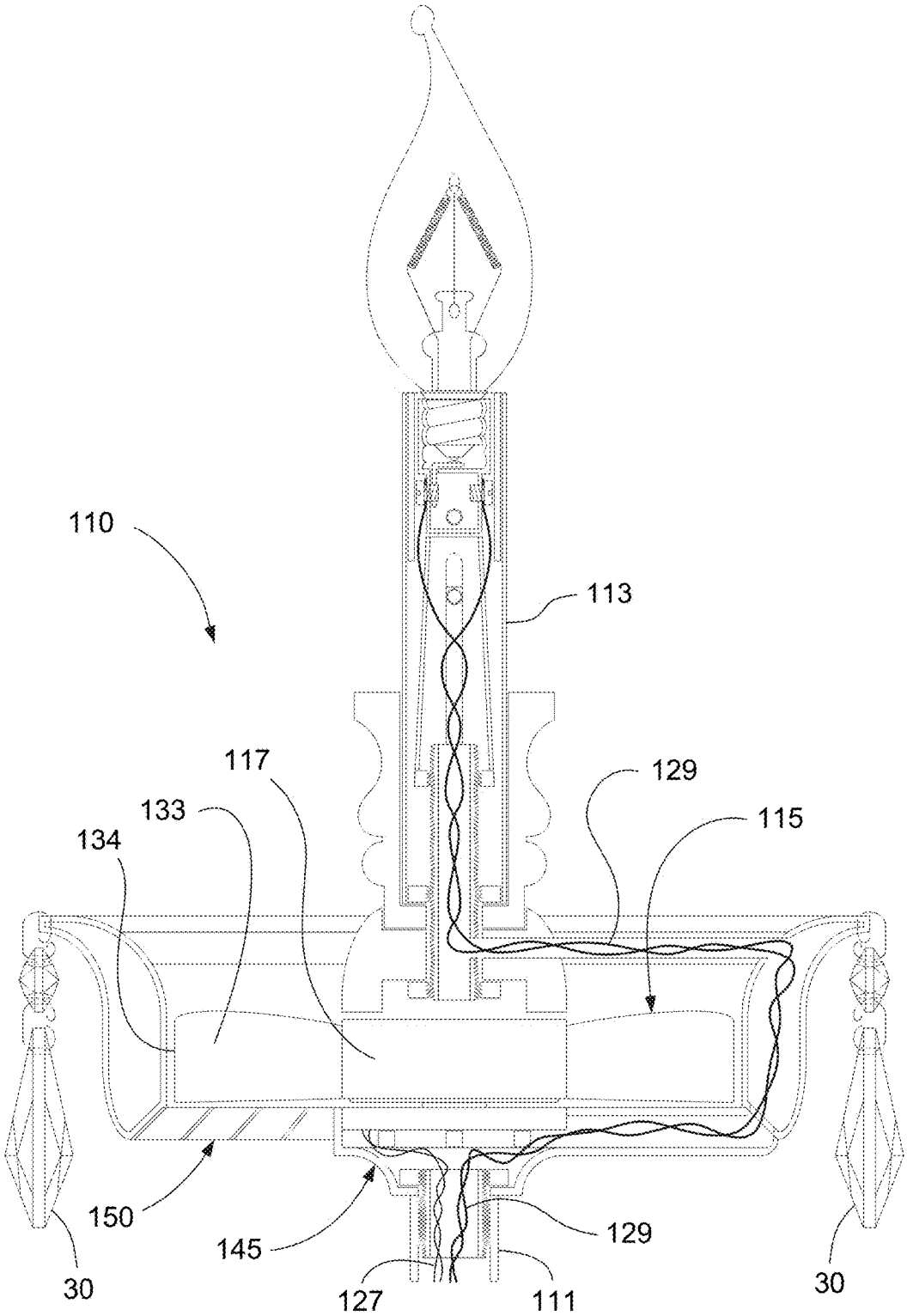
FIGS. 3A-3C detail in partial cross sections several embodiments of satellite fan and lighting units for the invention shown in FIG. 1.
Figure 3B:
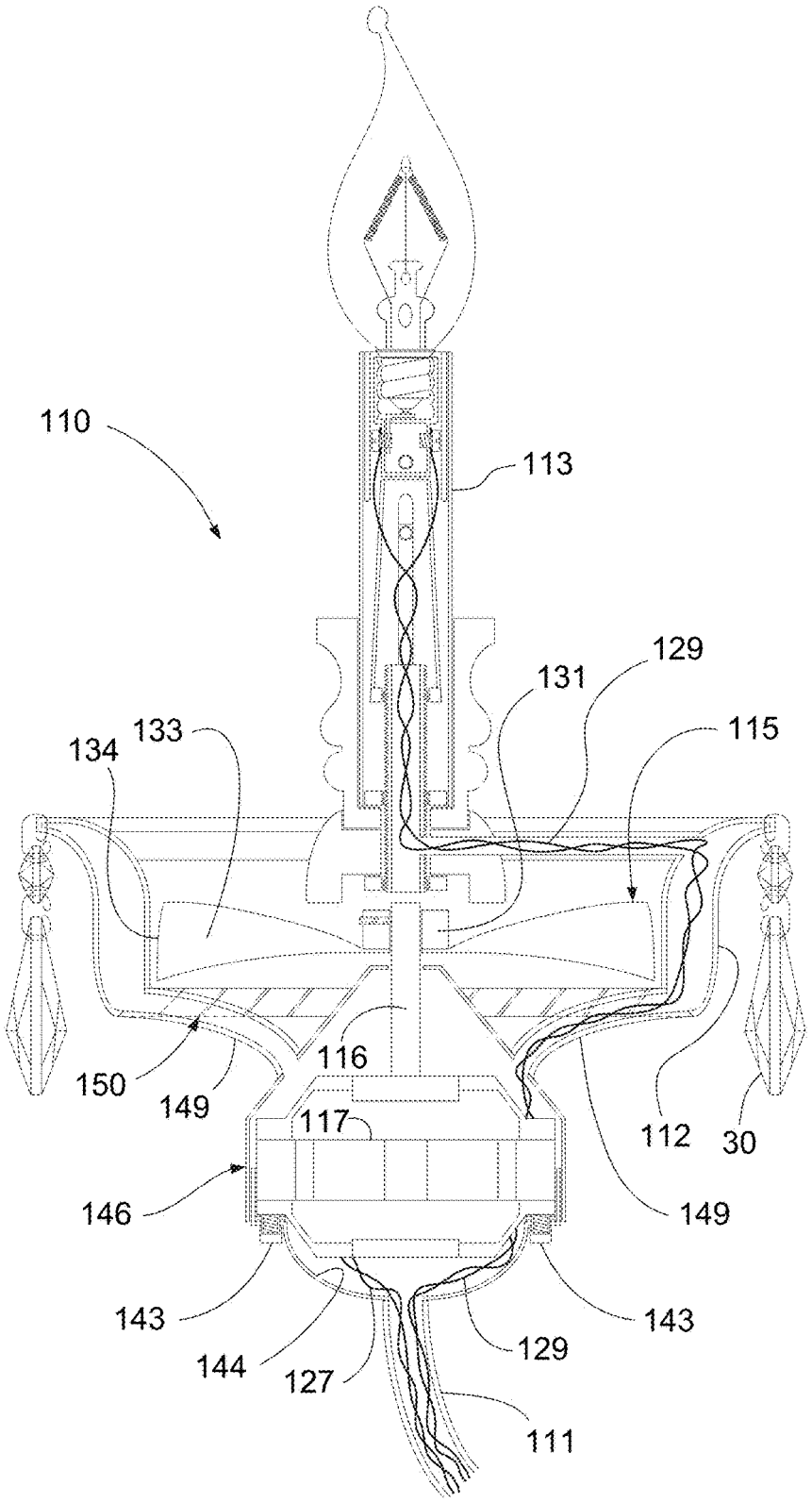
Figure 3C:
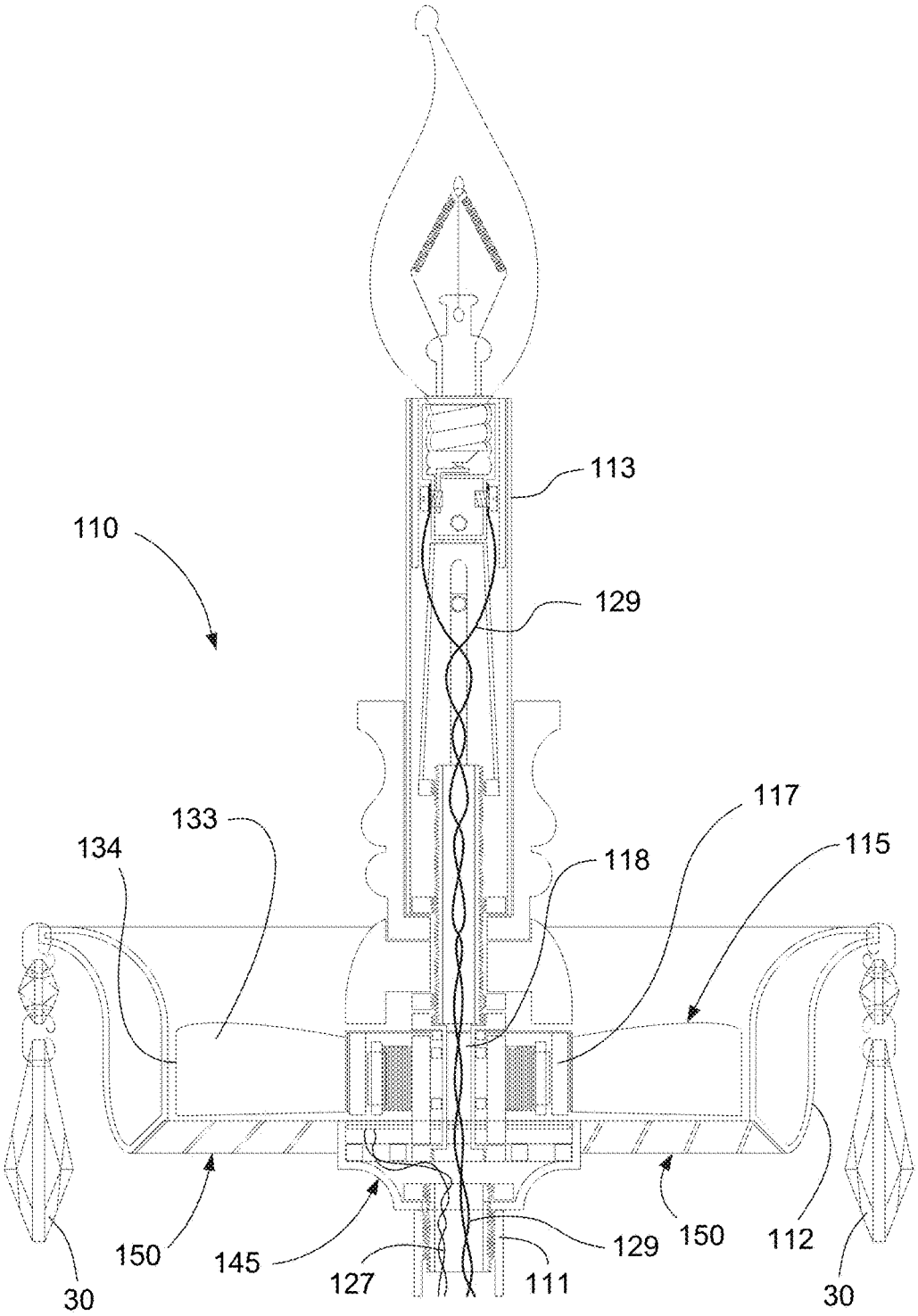

As seen in FIGS. 3A-3C, each of satellite units 110 also includes base 145 disposed on the distal ends of arms 111. Preferably, as with central fan unit 120, case style fan 115 includes motor 117 coplanar with fan 115. Base 145 serves primarily as structural support for satellite 110. As depicted in FIG. 3B, however, enlarged alternate base 146 encloses motor 117, as discussed above for alternate base 141 for central fan unit 120.

Arms 111 also serve as ducts for wiring 127, 129 extending from central body 102 to satellites 110 to power fans 115 and lights 113 respectively. While motor wire 127 stops within base 145 to serve motor 117, light wiring 129 extends to lights 113 above shroud 112 by one of two routes. As depicted in FIG. 3A, shroud 112 surrounding fan 115 provides a hollow path for lighting wiring 129 similarly to the way motor wiring 127 reaches motor 117 in central fan unit 120 (FIGS. 2A, 2B) In FIG. 3C, alternate fan 115 includes coaxial motor 117 having hollow axial channel 118 for light wiring 129 to pass through to light 113, obviating the need to run wiring 129 through shroud 112.

Electrically Driven Fans

Continuing now with FIGS. 1-3C, fans 115, 125 preferably are driven by electric motors 117 (FIGS. 2A-3C) for quietness, ease of construction and efficiency of operation. As mentioned above, fans 115, 125 preferably comprise radial blade, bi-directional, 120 volt A/C fans having motor 117 coaxial with hub 131 and with blades 133 which terminate in margins 134 opposite hub 131. A suitable fan 115, 125 of this type is available as catalog number NMB-MAT 5915PC-12T-B20-A00 (central fan 125) or NMB-MAT 4715FS-12T-B50-D00 (satellite fan 115) from NMB, Inc. of Chatsworth, Calif. Alternate fans 115, 125 having separate motors 117 concealed within bases 141, 146 preferably are axial propeller fans (10 wing) available as catalog number AD10-5.00-CC-B-37-0.25 from Air-Drive, Inc. of Gurnee, Ill., used with motor 117 available as catalog number 2M566 from W. W. Grainger, Inc., of Chicago, Ill., USA.

Electric power to fans 115, 125 preferably is provided by wires 127 (FIGS. 1, 2A) extending from control switches located conveniently within the room (not shown) through ceiling 5 and mast 13 into shroud 122 to central fan 125. Wires 127 optionally also could power satellite fans 115 by simply branching within base 140 (not shown) and extending through arms 111 to each of satellites 110. In such case, controlling the speed of central fan 125 necessarily would control proportionally the speed of satellite fans 115.

Preferably, however, separate controls for fans 115 are provided for each satellite 110 so that each of fans 115 may be controlled separately not only from central fan 125 but also from each other. Switches 128 disposed on arms 111 (FIG. 1) provides such control. Switch 128 preferably comprises a rheostat capable of regulation the speed of fan 115 and is mounted within easy reach of diner 6 from seat 3. This gives each diner 6 the option to optimize air flow 157, 158 directed toward himself by adjusting the speed of fan 115 nearest him.

Circuitry controlling fans 115, 125 and lights 113 is conventional within the electrical arts and unnecessary to detail herein. It will be recognized, however, that switches controlling fans 115, 125 and lights 113 may be either simple on/off switches capable of switching inductive loads or rheostats that provide continuously variable control. All such wiring 127-129 will be of appropriate size, voltage and frequency generally known and available for the installation (typically 120 volts, 60 cycles in the United States) to provide ample power to their respective devices.

Fans 115, 125 have been discussed above as being 120 volt A/C powered, but they also could comprise 24 or 48 volt D/C motors supplied from a separate power supply (not shown). Such power supply could be incorporated within central body 102 or base 141 disposed thereon (neither shown) or supplied as part of the building wiring (e.g. located above ceiling 5). One having ordinary skill in the art will recognize that all such variations are considered to be within the spirit and scope of the present invention.

Mechanically Driven Fans

Referring now to FIGS. 6-9, alternate fan chandelier 200 comprises central body 228 supported by mast 205 from ceiling mount 202. A single electric motor 201 within ceiling mount 202 rotates shaft 203 to drive transmissions 220 within housing 222. One having ordinary skill in the art will recognize that motor 201 need not necessarily be contained within mount 202, but could be carried within central body 228 (not shown) and thereby disposed closer to transmission 220 discussed in detail below. Housing 222 supports arms 211 bearing on their ends distal housing 222 satellite fan and light units 210. Satellites 210 include bases 240, fans 215 and lighting 213 as discussed above for the electric driven units 110. Fans 215, however, are driven without the need for electrical power to bases 240, as discussed below.

Disposed within housing 222, transmission 220 comprises a single drive gear 221 coupled to shaft 203. Coplanar satellite, or spur, gears 223 mesh with drive gear 221 and rotate simultaneously therewith to turn flexible drive cables 230 extending through arms 211 to satellites 210. Within each satellite 210, cable 230 extends coaxially with base 240 (FIG. 8) to terminate in spline 218 which meshes with hub 216 of fan 215. Rotation of shaft 203 thereby rotates drive gear 221, satellite gears 223, flex cables 230, spines 218 and fans 215, thereby operating all satellite fans 215 with a single motor 201.

In an alternate embodiment of satellite 210 (FIG. 9) where arm 211 does not approach satellite 210 coaxially with base 240, cable 230 instead meshes with differential 231, comprising beveled gears 235, 236. Differential 231 converts horizontal rotation of cable 230 into vertical rotation of spine 218. Spine 218 then extends upward to engage hub 216 as discussed above.

Motor 201 preferably comprises a permanent, split-capacitor, ⅛ horsepower, three speed induction motor adapted to turn at approximately 1075 rpm. Using a 2.8:1 drive ratio, spur gears 223, flexible cable 230 and hub 216 preferably turn at a maximum rotation of 3000 rpm. A suitable motor 201 is available from W.W. Grainger, Inc. of Chicago, Ill., USA, as catalog number 4UY17. Flexible cable 230 preferably is a bi-drectional, flexible shaft cable. A suitable cable 230 is available from SS White Technologies, Inc., Piscataway, N.J., USA, as catalog number FR130SLPCC01800.

Where wiring must accompany cable 230 within arms 111, a hollow-core flexible cable is preferred to prevent cable 230 and wiring 127, 129 from interfering with each other. A suitable transmission 220 also is available from Suhner Manufacturing, Inc. of Rome, Ga. A suitable hollow-core cable is available as catalog number A-250-4143 from Suhner Manufacturing, Inc. of Rome, Ga.

Chart A shows availability of the foregoing and of additional suitable products which may be used for various components discussed herein.

Diffusers

Disposed coaxially with and immediately above bases 140, 141, 145, 146, 240, diffusers 150 define the air flow from satellites 110 and central fan unit 120. Depending upon the air flow pattern desired (see FIGS. 4A-5B), diffusers 150 utilize one of several grates 170, 180, 190, 195 or 198, each discussed in detail below. Diffusers 150 mount just below and coaxial with fans 115, 125 and utilize a select one of grates 170-198 depending upon the location on fan chandeliers 100, 105, 200 and upon their configuration. Diffusers 150 direct air flow as indicated by flow arrows 157, 158 in FIGS. 4A, 5A.

As depicted in FIG. 4A, differential flow direction arrows 157, 158 indicate not only the direction but also the volume of air flow from satellites 110. Larger arrows 158 indicate air flow substantially parallel to arms 111 and substantially radial from fan chandelier 100, while smaller arrows 157 represent significantly lesser air flow directed at an angle to axis A of each of arms 111. Such air flow expands the reach of air flow envelope 166 (FIG. 4B) while keeping it within the desired direction. Further, as indicated by shorter arrows 157, lateral air flow from one satellite 110 will flow at an angle to axes A and may encounter that from adjacent satellites 110, whereupon it can co-mingle therewith and may be partially redirected toward edge 4 of table 1. This arrangement provides a more uniform distribution of air flow over table 1 than would occur if air simply flowed following arrows 158 and parallel arms 111.

Figure 4B:
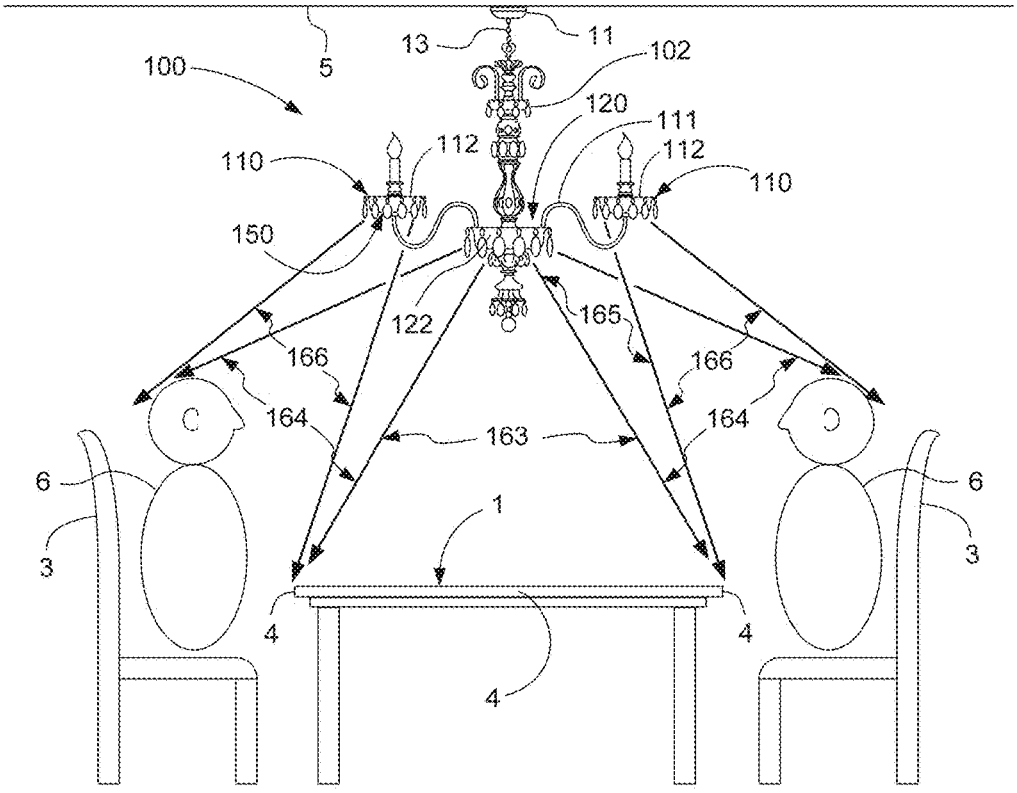
FIG. 4B shows a partial elevation of the chandelier and dining table arrangement of FIG. 4A.
Figure 5A:
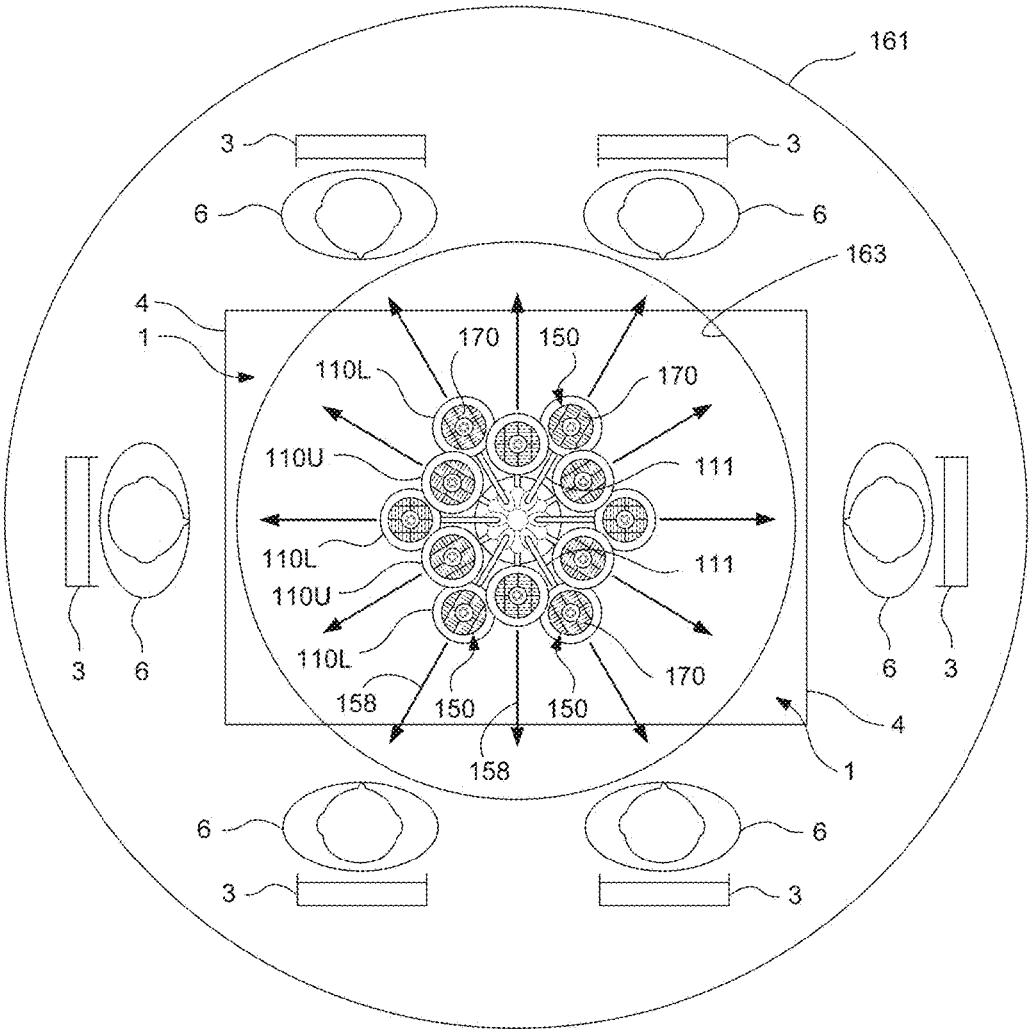
FIG. 5A shows a plan view of an alternate embodiment of the chandelier and dining table arrangement of FIG. 4A.
Figure 5B:
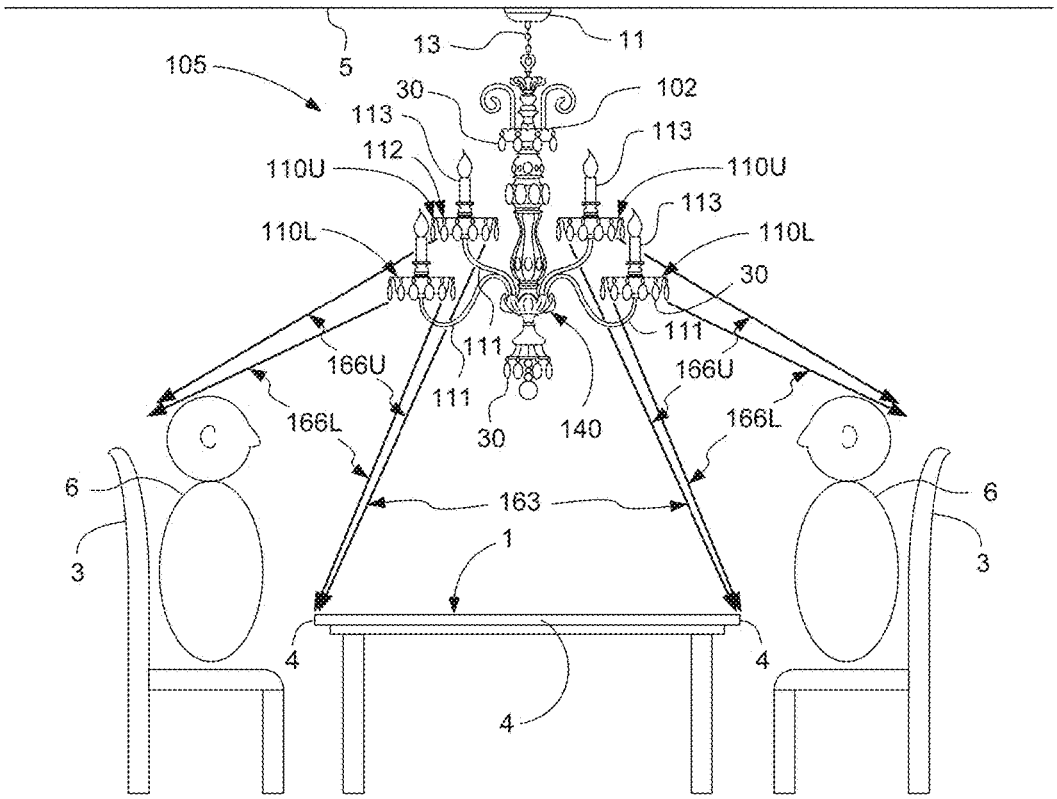
FIG. 5B shows a partial elevation of the chandelier and dining table arrangement of FIG. 5A.
Figure 6:
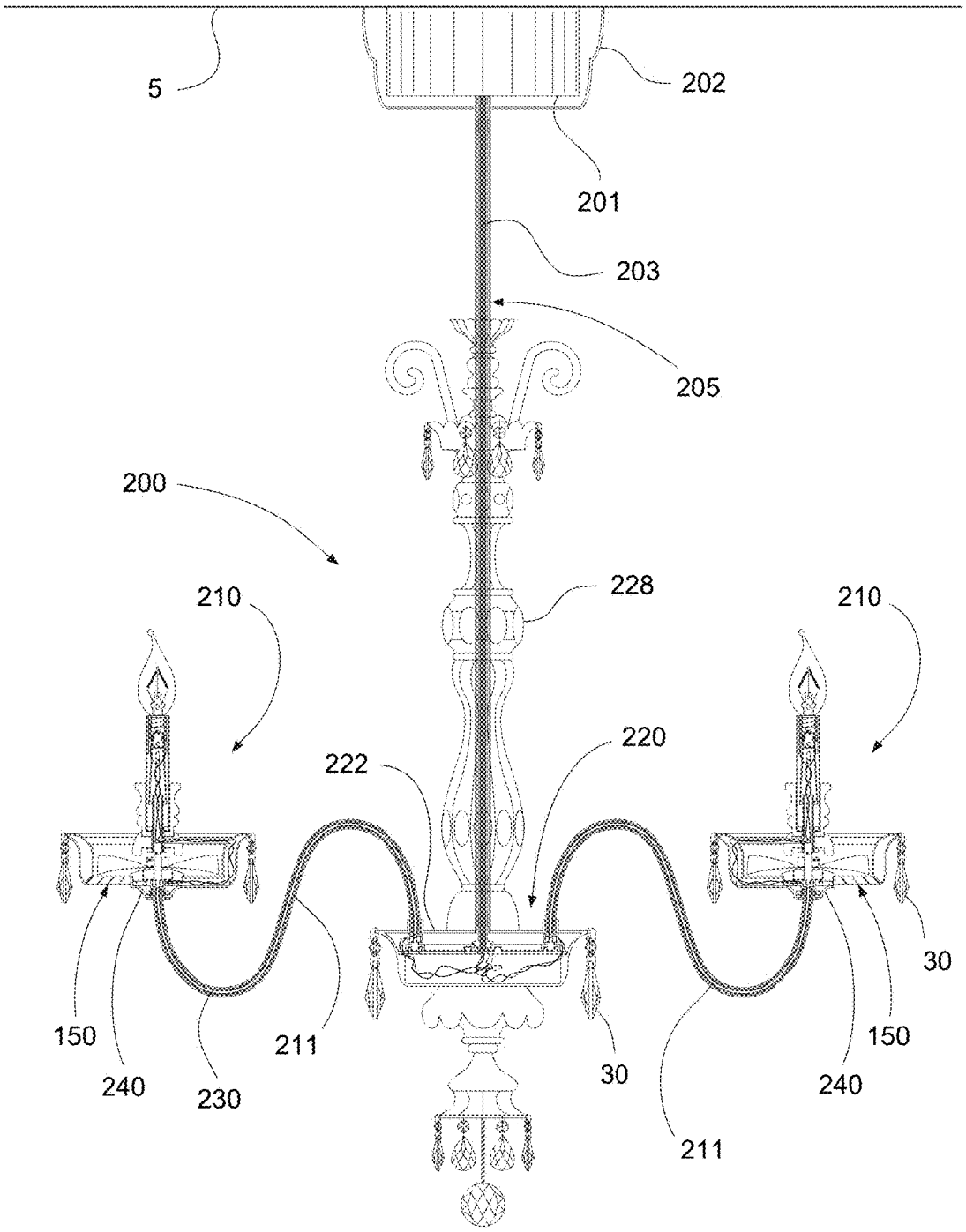
FIG. 6 depicts in elevational view an alternate embodiment of the chandelier fan of the present invention having a mechanical fan drive system.
Figure 7A:
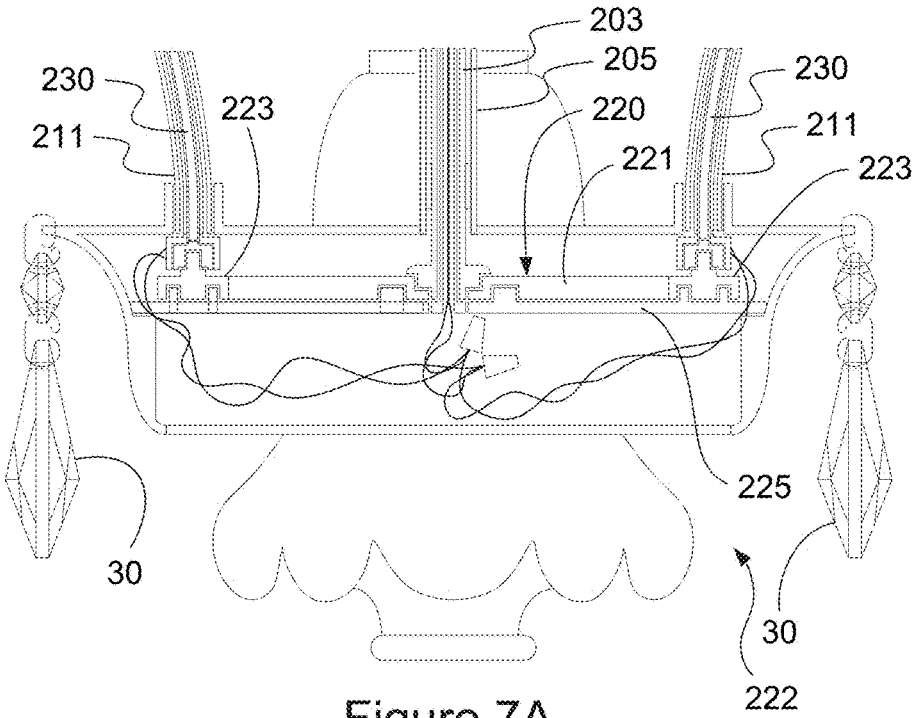
FIGS. 7A, 7B detail in partial cross section and plan views a transmission drive mechanism in the central body of the alternate embodiment of FIG. 6.
Figure 7B:
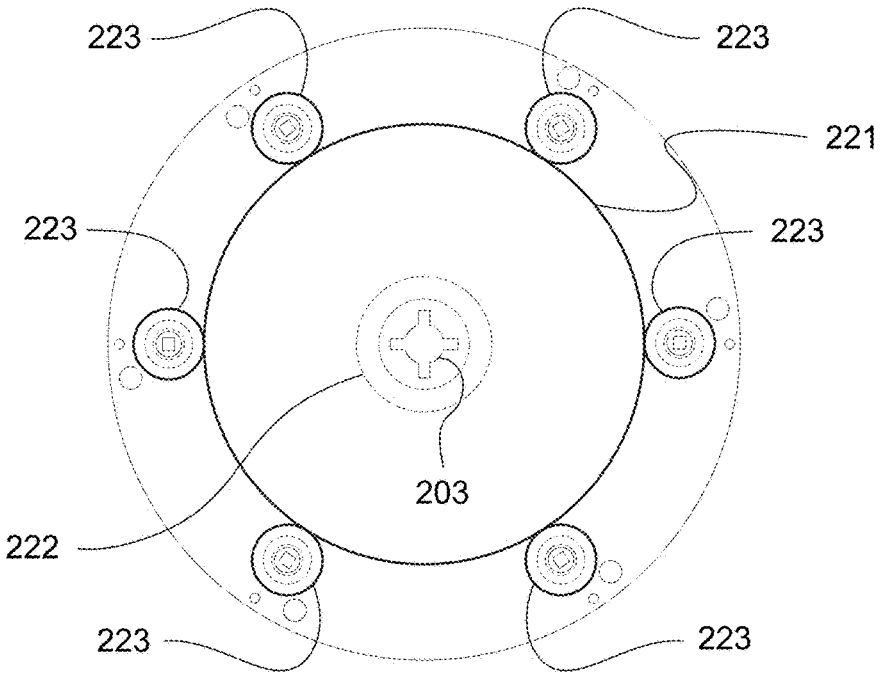
Figure 8:
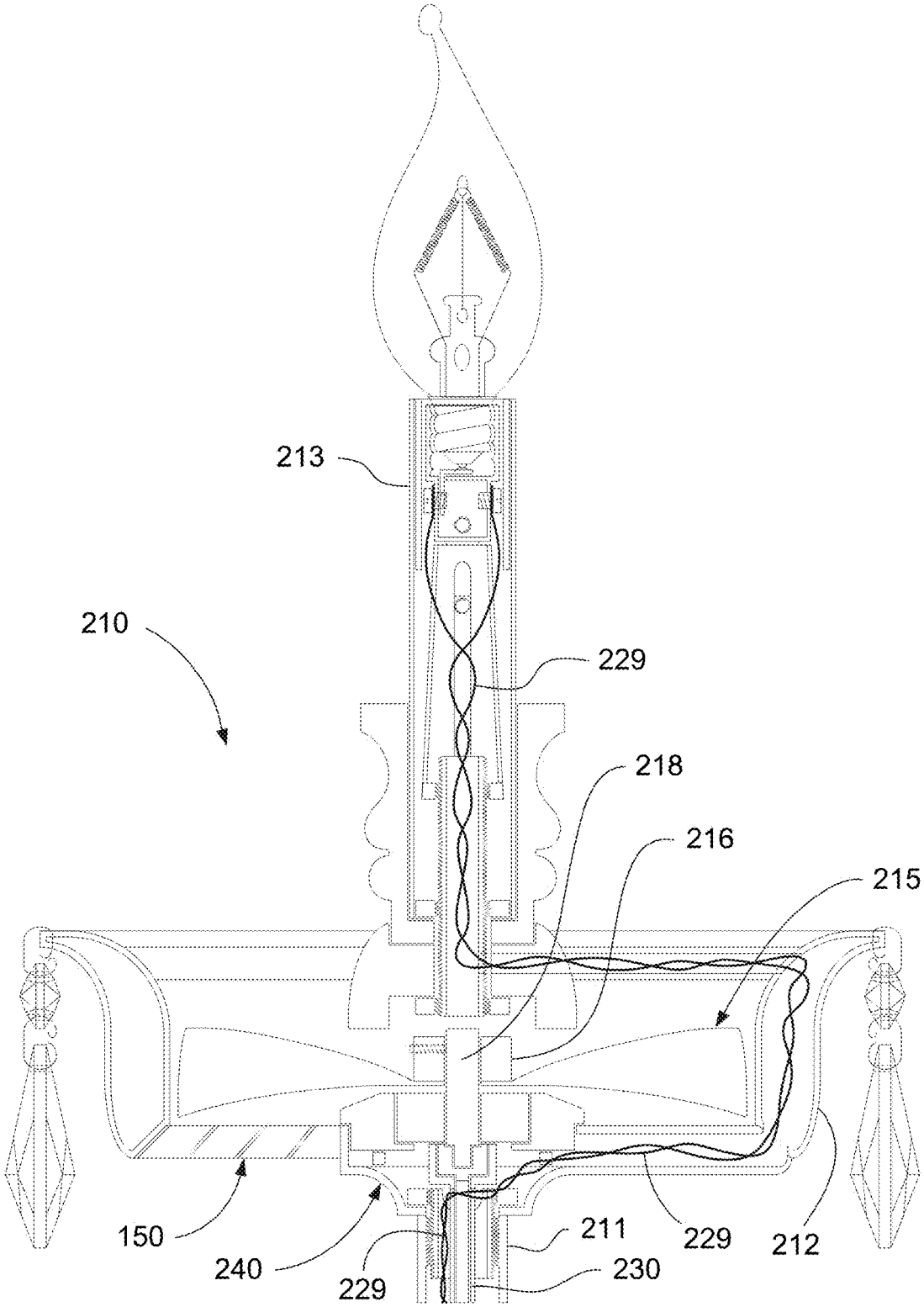
FIGS. 8, 9 detail in partial cross sections alternate drive systems for the satellite fan units of the alternate embodiment of FIG. 6.
Figure 9:
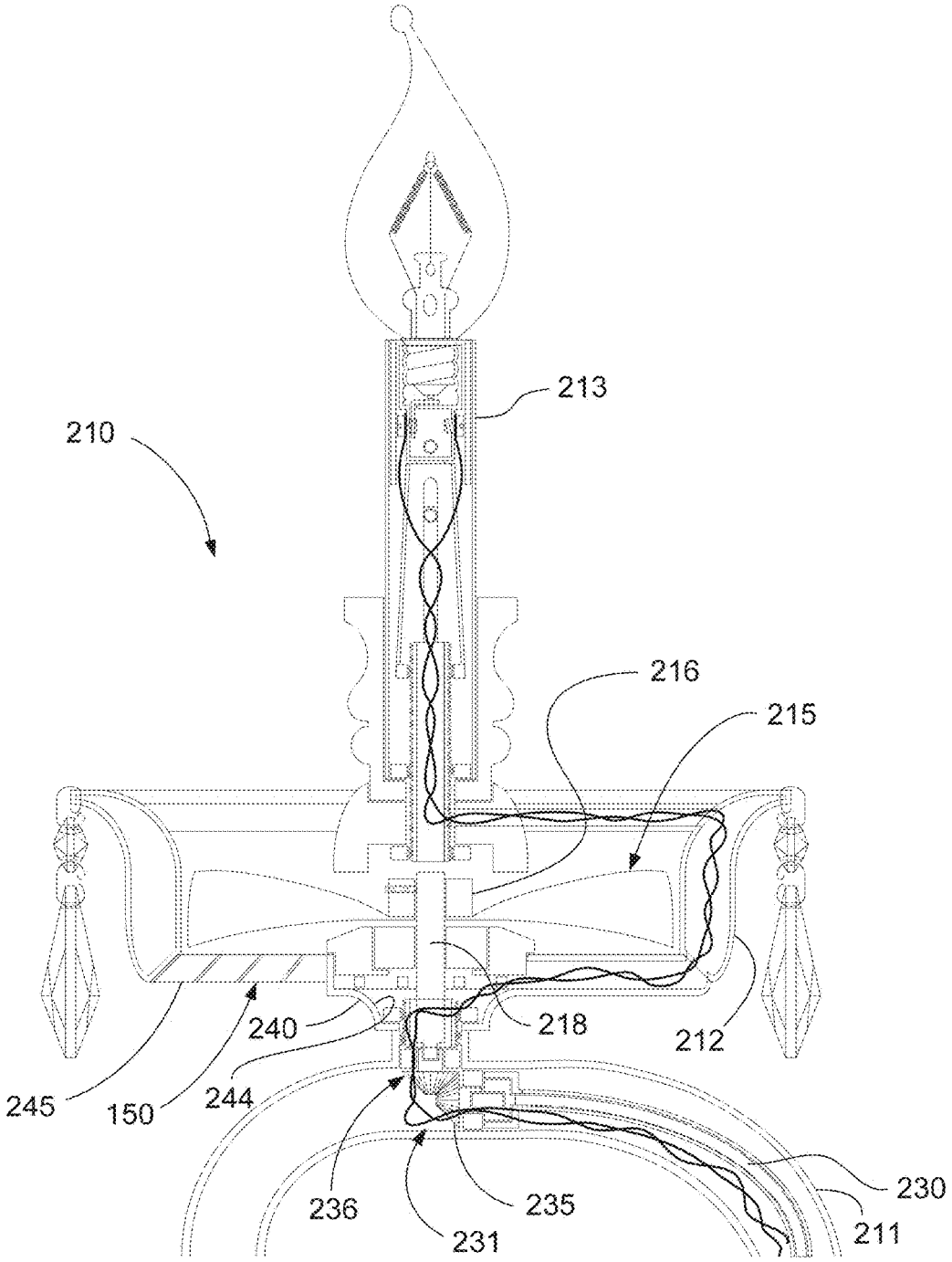

As best seen in FIGS. 4B, 5B, diffusers 150 cast air flow "shadows" 163, 165 within region of influence 161 of fan chandeliers 100, 105, 200. Shadows 163, 165 cause seats 3, but not table 1, to be within the areas most affected by fans 115, 125. This has at least three benefits. First, diners 6 seated within the air flow envelopes 164, 166 experience the beneficial cooling or warming effects of fans 115, 125, thus enjoying the comfort level of a ceiling fan. Second, air flow within envelopes 164, 166 does not pass across food, drink or other materials on table 1, deterring any deleterious effects of such air flow. For example, food will not be unduly cooled, or loose papers will not be blown around, by such air flow otherwise covering the entirety of the area within region 161. Third, effective movement of air is achieved using substantially reduce power requirements when compared to traditional ceiling fans. Thus, the present invention represents a significant improvement over conventional ceiling fans which simply blow air downward toward table 1 in a cone-shaped envelope within region of influence 161 of fan chandelier 100, cooling food and moving papers in the act of providing comfort control to diners 6 in seats 3.

Diffuser Grates

Figure 10A:
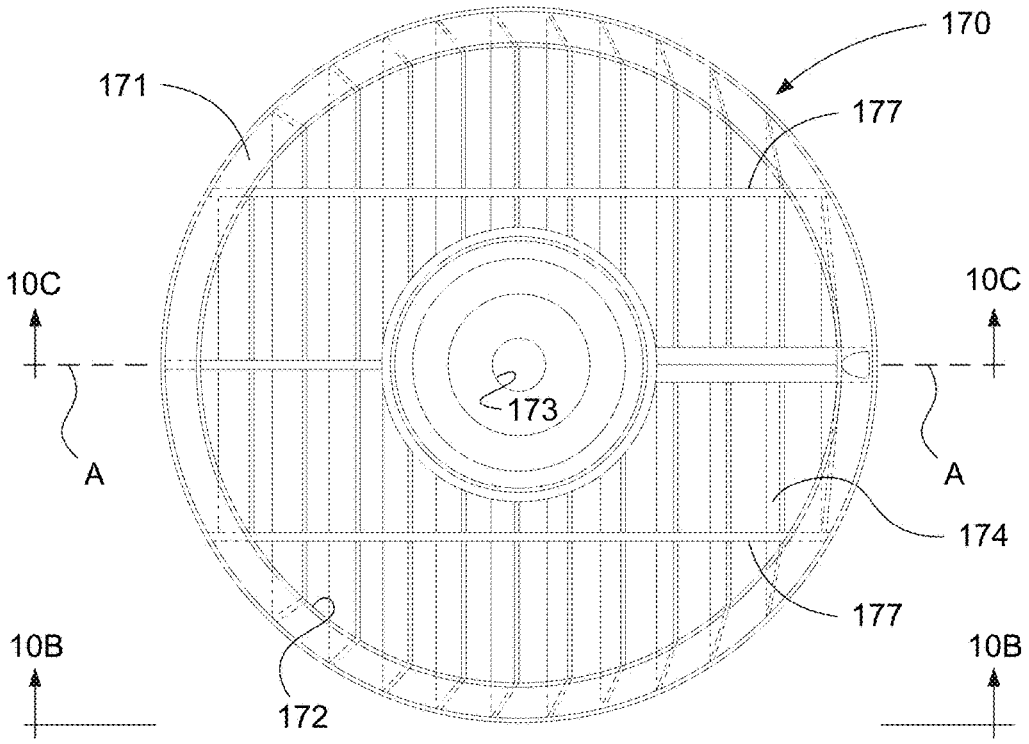
FIGS. 10A-10C show a preferred embodiment of a diffuser grate for use with the satellite fans of the present invention, particularly as depicted in use in FIG. 5A.
Figure 10B:
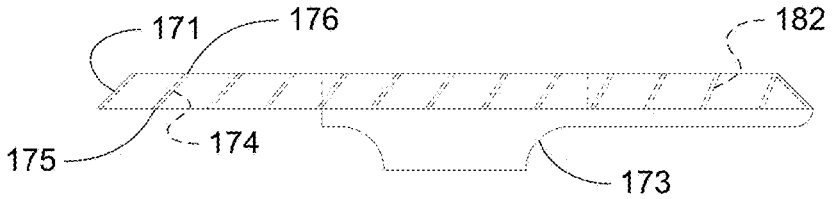
Figure 10C:
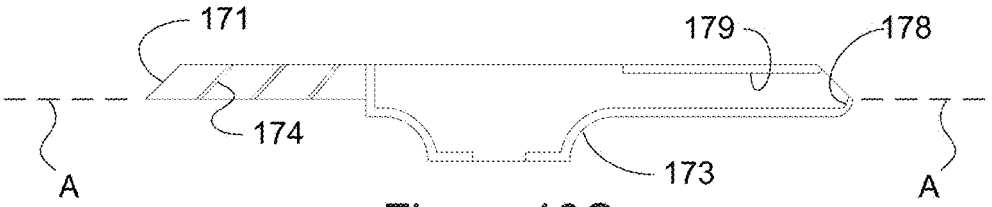
Figure 11A:
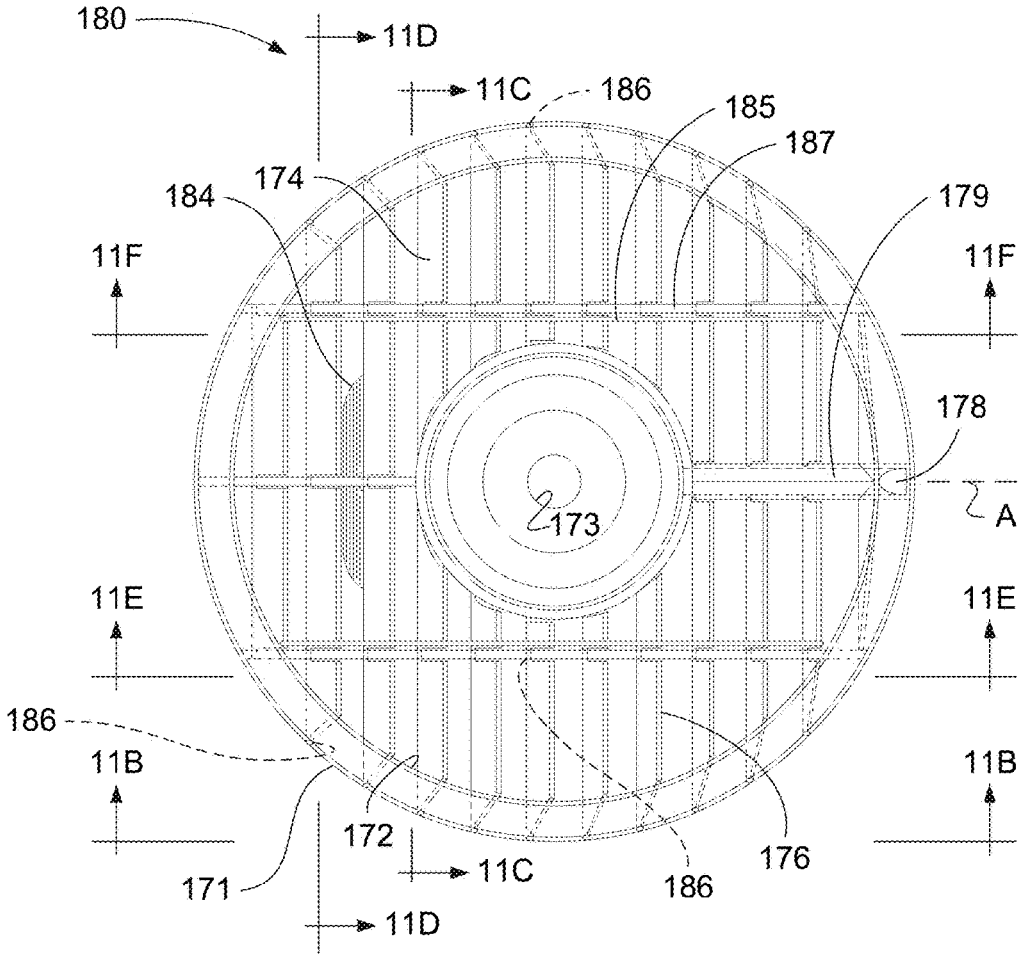
FIGS. 11A-11F show an adjustable variant of the diffuser grate of FIGS. 10A-10C.
Figure 11B:
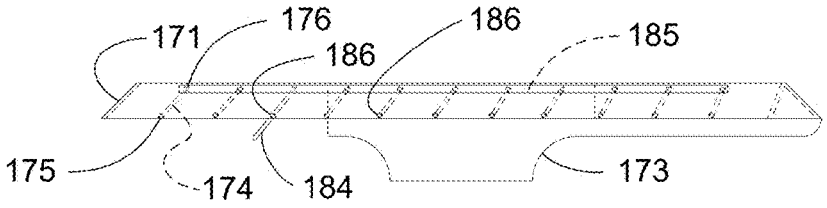
Figure 11E:
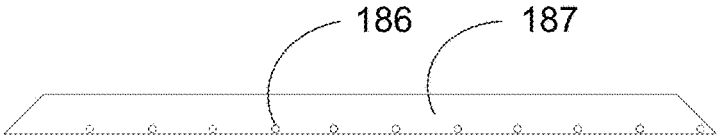
Figure 11F:
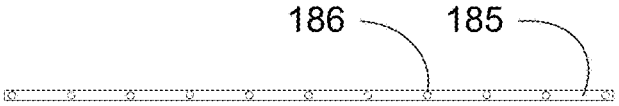
Figure 11C:
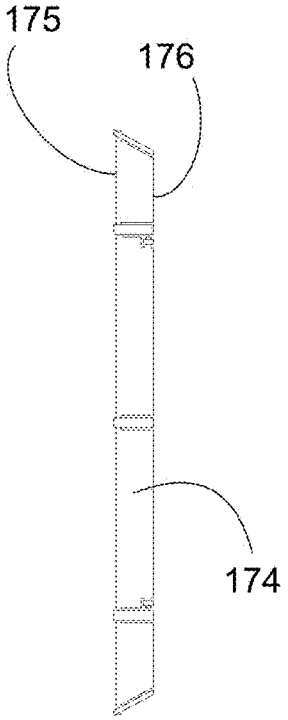
Figure 11D:
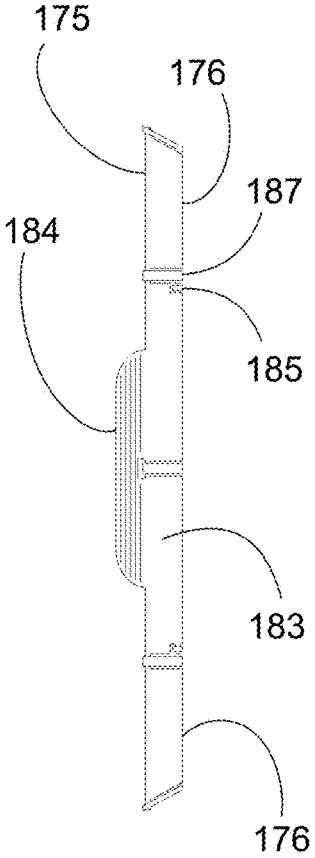

Referring now also to FIGS. 10A-10C, grate 170 comprises a substantially planar array having circular perimeter 171 defining coaxial port 172 through which air flows from fan 115. Grate 170 couples to base 145, 146 by hub interface 173. Wiring channel 179 extends radially along axis A rearward (toward central body 120) from hub interface 173 to terminate in aperture 178 through perimeter 171. Channel 179 and aperture 178 thereby provide a path for wiring 127 (FIG. 3A) to circumvent the blades of fan 115 on its way to serve light unit 113 atop satellite 110.

Grate 170 further includes fixed vanes 174 disposed substantially parallel to each other and forming chordal slats dividing port 172 into substantially rectangular sections transverse to axis A. Braces 177 paralleling axis A stabilize vanes 174 along their length between opposite sides of perimeter 171 and deter a vortex effect upon the air flowing through diffuser 150.

Forward vanes 174 (farthest from aperture 178, and thus central body 102) are disposed at a relatively shallow angle compared to more rearward vanes 174, their lower edges 175 being substantially more distal hub 173 than their upper edges 176. By contrast, rearward vanes 174 are affixed much more upright, so that their lower edges 175 are disposed more directly beneath their upper edges 176. This arrangement causes air flowing across forward vanes 174 to be directed in a more horizontal direction, thereby defining an outer limit, most distal from central body 102, of region 166 (FIGS. 4B, 5B) affected by satellite 110 fans 115. Rearward vanes 174 by contrast direct air in a more vertical direction to define an inner limit of region 166 closest to central body 102. Grates 170 produce the substantially straight air flow 158 depicted in FIG. 5A.

Referring now to FIGS. 11A-11F, grate 180 comprises a variant of grate 170 having adjustable vanes 174. Like grate 170, grate 180 comprises circular perimeter 171 forming opening 172 divided into substantially rectangular sections by transverse vanes 174. Further, vanes 174 most distal aperture 178 are biased more horizontally than rearward vanes 174 closest to aperture 178. Instead of rigidly affixed to perimeter 171, however, vanes 174 pivotally attach thereto only at their bottom edges by pivots 186. This allows the vertical pitch of vanes 174 to be adjusted, thereby better controlling the direction of air flow 158. Top edges 176 of vanes 174 are affixed relative to each other by linkage 185, causing all of vanes 174 to rotate about pivots 186 in concert when any one of them is adjusted. Handle 184 may be provided on bottom edge 175 of one or more of vanes 174 for convenience in adjusting vanes 174 from beneath. Rigid braces 187 extend parallel axis A and couple to vanes 174 with additional pivots 186 to stabilize vanes 174 longitudinally. This adjustable vane system enables air envelope 166 to be redirected horizontally (FIGS. 4A, 5A) closer to or farther from the vertical centerline of fan chandelier 100 to accommodate tables 1 of different sizes.

Figure 12A:
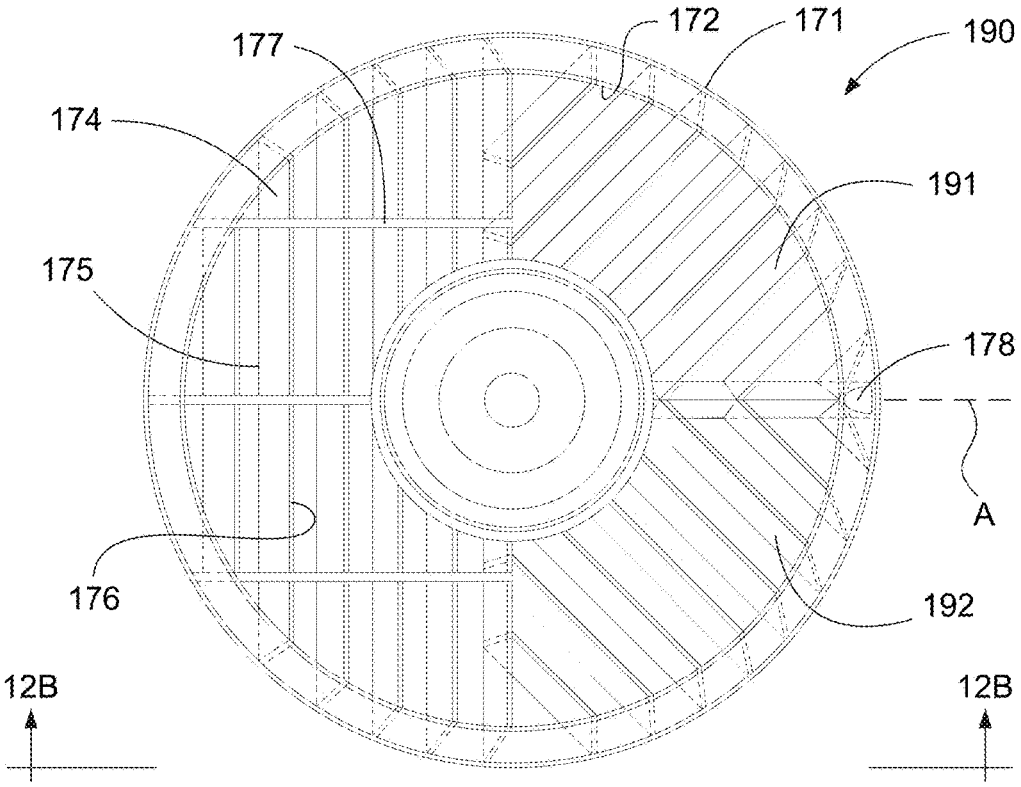
FIGS. 12A-12B show an alternate embodiment of a diffuser grate for use with the satellite fans of the present invention, particularly as depicted in use in FIG. 4A.
Figure 12B:
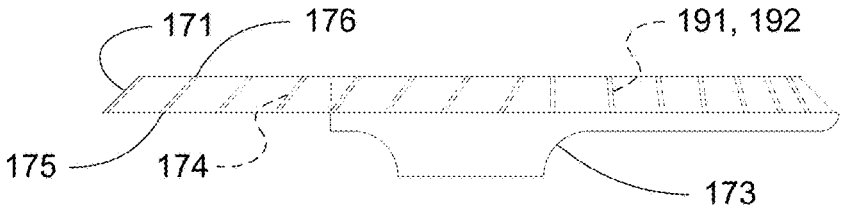

Referring now to FIGS. 12A-12B, grate 190 comprises an alternate embodiment of diffuser 150 having substantially the same configuration as grate 170 except that rearward vanes 191, 192 are disposed at an angle to axis A. Preferably, vanes 191, 192 disposed on opposite sides of axis A are angled approximately ninety (90) degrees to each other with axis A bifurcating said 90 degree angle. This causes vanes 191 and 192 to be disposed at 45 degrees to axis A but angled in opposite directions. Further, the portion of port 172 covered by vanes 191, 192 comprises approximately half of port 172, vanes 191 and 192 each covering substantially equal portions thereof. One having ordinary skill in the art will recognize that the angle between vanes 191, 192 and the portion of aperture 172 they cover may vary significantly without departing from the spirit and scope of the present invention. Grate 190 produces the air flow pattern depicted in FIG. 4A.

Figure 12C:
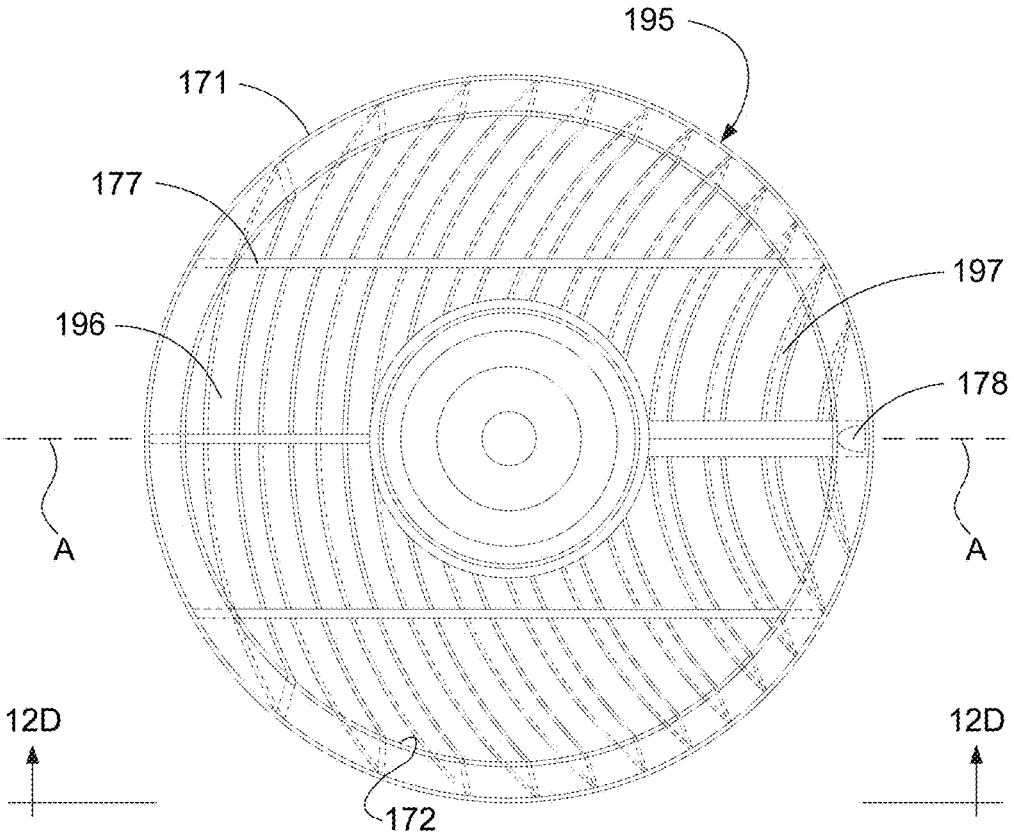
FIG. 12C, 12D show a variant of the diffuser grate of FIGS. 12A-12B having curved vanes.
Figure 12D:
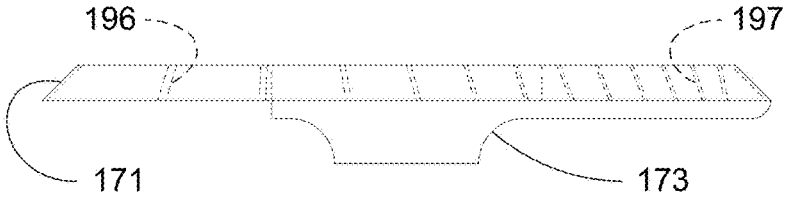

Referring now to FIG. 12C, another alternate diffuser 150 embodiment comprises grate 195 also having circular perimeter 171, but divided by curved vanes 196, 197 instead of straight vanes 174. Forward vanes 196 comprise a larger radius, and thus less curvature, while being pitched most horizontally (with their lower edges extended the farthest), thus directing air most parallel to axis A as depicted in FIG. 4A by arrows 158. By contrast, rearward vanes 197 comprise shorter radius, more curved slats which more closely simulate rearward vanes 191, 192 of diffuser 190. Braces 177 of grate 195 parallel axis A as discussed above for grates 170, 180, 190 to vanes 196, 197 along their length and to suppress twisting of air flowing through grate 195 caused by curved vanes 196, 197. Grate 195 thus produces an air flow pattern similar to that of grate 190, as depicted in FIG. 4A.

Figure 13A:
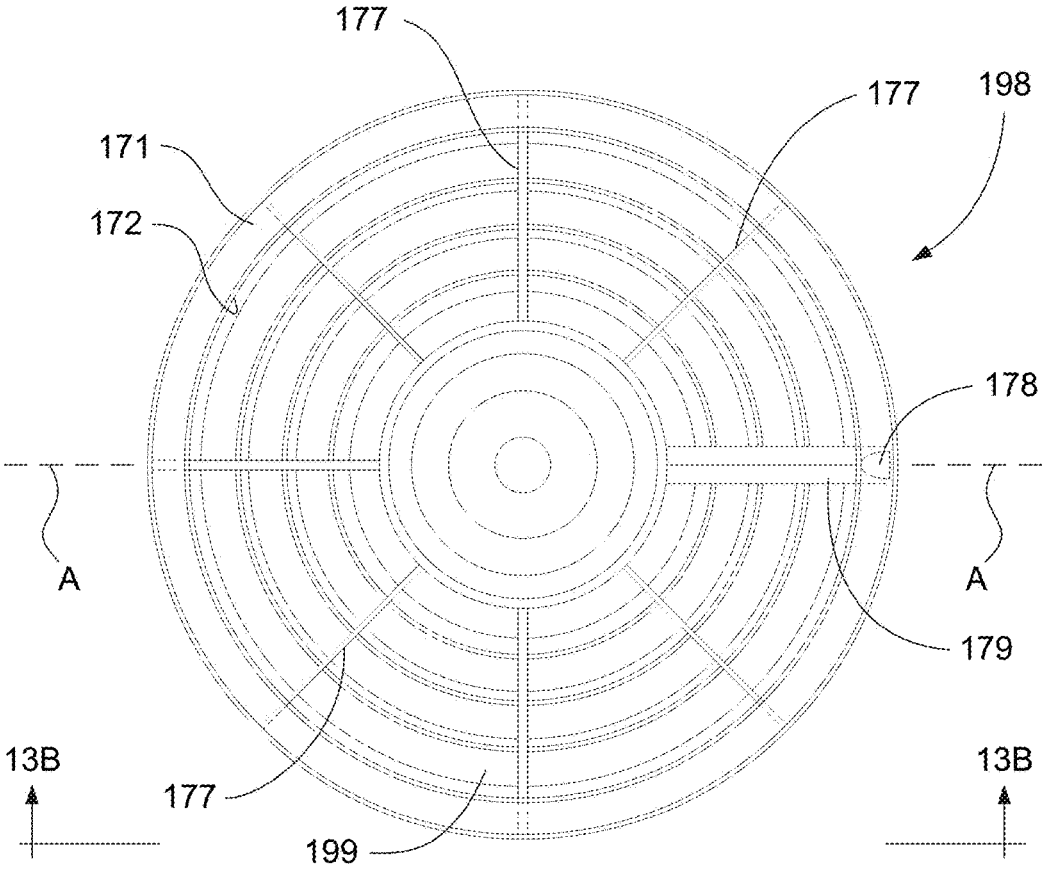
FIGS. 13A-13B show a diffuser grate for use with the central fan of the preferred embodiment of FIG. 1 which employs concentric, curved vanes.
Figure 13B:
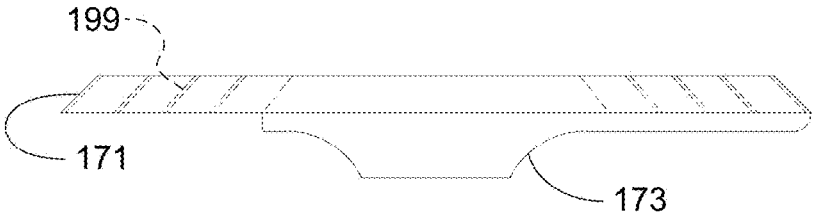

Referring now to FIGS. 13A, 13B, grate 198 comprises a substantially circular diffuser 150 for use with central fan 120. Grate 198 employs circular vanes 199 concentric about base 140, 141 and hub 173. Braces 177 radiate from hub 173 in all directions to divide vanes 199 into even degrees of arc around hub 173. Unlike grates 170, 180 and 190, where lower edges 175 of vanes 174 gradually extend farther from central body 102 than their upper edges 176 as vanes 174 are disposed farther from aperture 178, vanes 199 of grate 198 all are affixed to braces 177 at a consistent angle chosen for the desired directivity of air flow 158, thereby defining undisturbed region 166. Despite this, one having ordinary skill in the art will recognize that vanes 199 could vary in pitch just as do, e.g., vanes 196, 197 discussed above.

Comparing FIGS. 4A and 5A illustrates one reason for usage of different grates 170, 180, 190, 195, 198. In the single-tiered embodiment of fan chandelier 100 depicted in FIG. 4A, concern for interstitial regions between axes A of each of arms 111 leads to the need for the angled directivity of air flow 157 provided by rear vanes 174 of grate 170 and rear vanes 191, 192 of grate 190. By contrast, where the two tiered embodiment of fan chandelier 105 comprises arms 111 extending in a higher plane and bifurcating the angle between arms 111 in the lower plane, less concern arises that the interstitial regions of edge 4 of table 1 will be adequately served. Satellites 110U, 110L both may include straight diffusers 170, 180 which present a single directivity and amplitude to air flow 158.

Crystal Mountings

Crystals 30 on conventional chandeliers typically dangle from simple wire mountings. Though free to pivot from such mountings, crystals 30 seldom do so because air movement through such chandeliers, and any disturbance caused thereby, is minimal Encouraging air movement through fan chandeliers 100-200, as contemplated by the present invention, however, may generate significant oscillating movement of crystals 30 if they movably dangle. Such movement causes correspondingly increased movement of refracted light rays from lights 113, a largely undesirable effect. Accordingly, specialized crystal 30 connection hardware is useful to suppress such movement, at least where it may become pronounced.

As depicted in the figures (e.g. FIGS. 2A-3C), most crystals 30 may simply dangle from their attachment points without concern about excessive movement. Pronounced movement may occur, however, in at least one embodiment of the present invention. In FIGS. 5A, 5B, multilevel fan chandelier 105 includes upper satellites 110U disposed in a plane above lower satellites 110L. Even though diffusers 150 within satellites 110U employ grates 170 or 180 to direct air flow substantially parallel to arms 111U, and air flow is directed downward by diffusers 150 (FIG. 5B), some horizontal air dispersion occurs anyway. Since satellites 110U are disposed above adjacent satellites 110L, such horizontally dispersed air may flow across crystals 30 mounted on satellites 110L before encountering air movement from satellites 110L which might divert it. Thus, if crystals 30 on satellites 110L are free to dangle, air from satellites 110U may cause them to oscillate unacceptably.

Figure 14A:
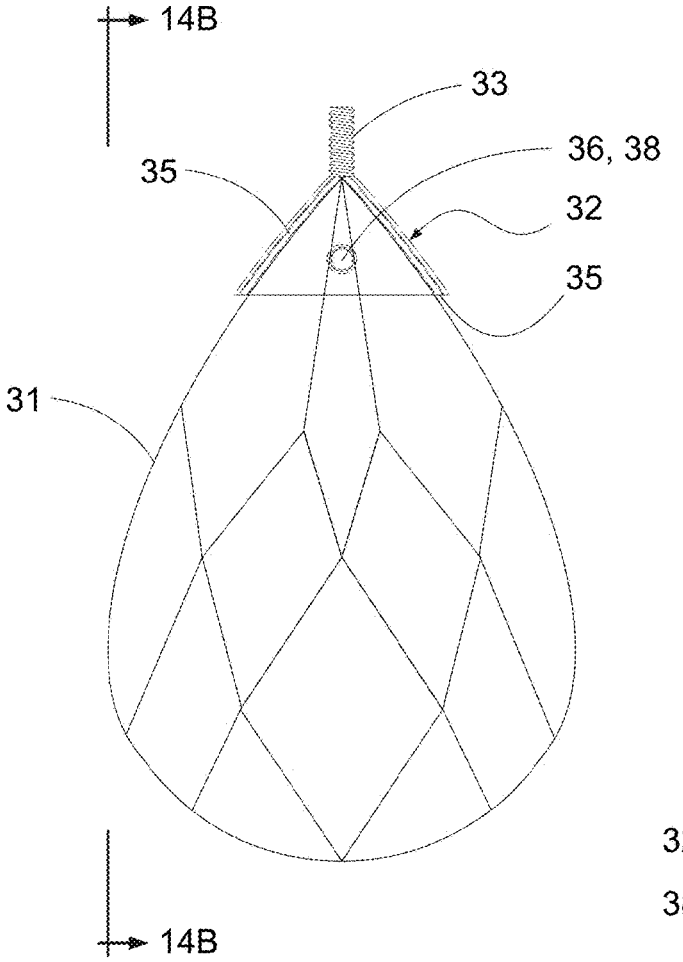
FIGS. 14A, 14B detail a rigid mounting system for light refracting crystals for use with the present invention.
Figure 14B:
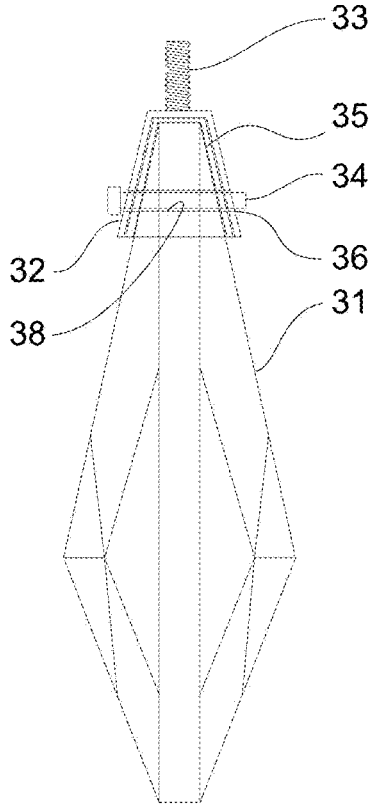

FIGS. 14A-14B depict a system for rigidly mounting crystals 30 such that they cannot move. Crystal 30 in FIGS. 14A, 14B comprises crystal bead 31 suspended from stud 33 by cap 32. Cap 32 comprises a substantially trapezoidal, inverted cup adapted to fit the upper end of bead 31 and hold it snugly and rigidly. One having ordinary skill in the art will recognize that cap 32's shape and size will vary with the shape and size of bead 31. Aperture 36 through bead 31 aligns with aperture 38 through the sides of cap 32, and pin 34 extends through apertures 36, 38 to secure bead 31 to cap 32. Cushioning material 35 may be provided within cap 32 to further dampen any movement of bead 31 relative to cap 32. Stud 33 screws into a threaded receptacle (not shown) provided for the purpose on shroud 112 on satellites 110L. When air from satellite 110U flows across crystals 30 on satellites 110L, crystals 30 will remain substantially immobile at least relative to shroud 112. Pin 34 may be removed for cleaning of bead 31 desired without having to remove cap 32 from shroud 112.

Heating

Figure 15B:
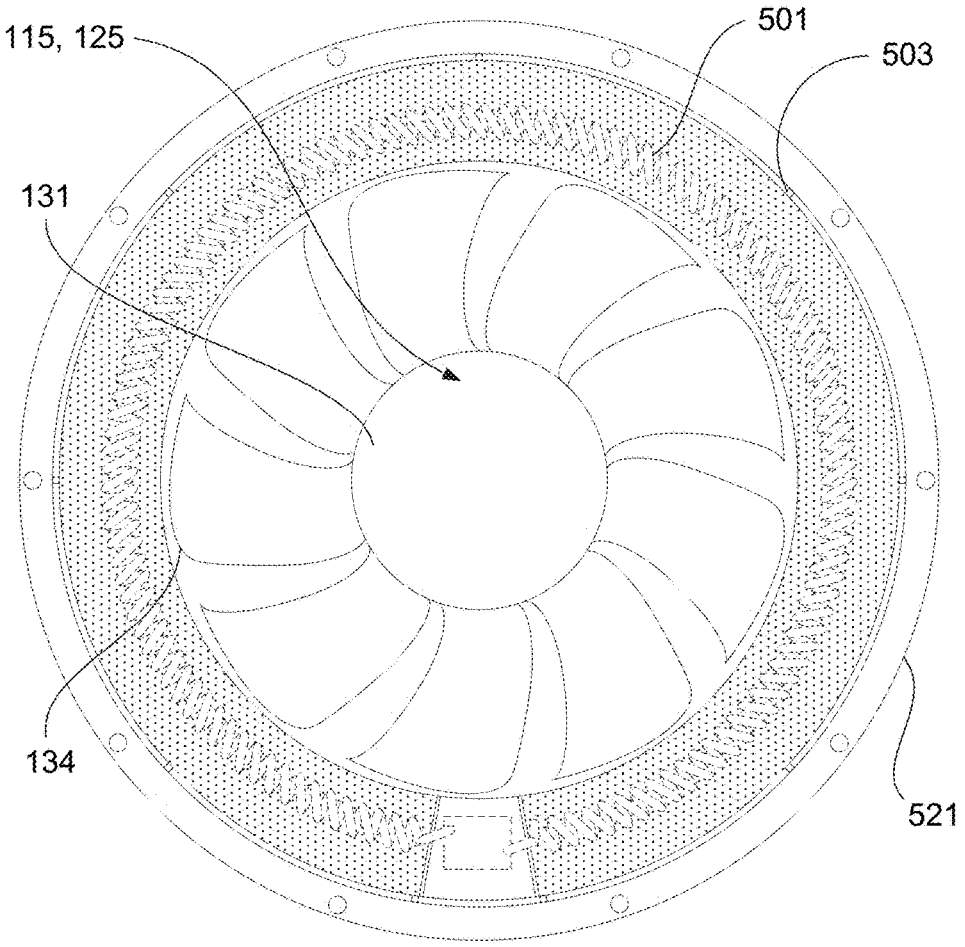
FIGS. 15A-15D detail means for heating air passing through the lighting units of the present invention.
Figure 15A:
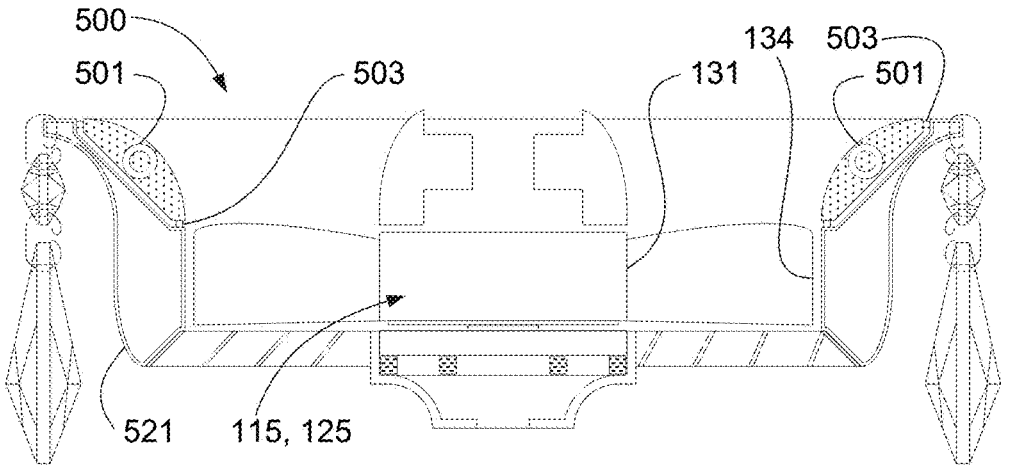
Figure 15D:
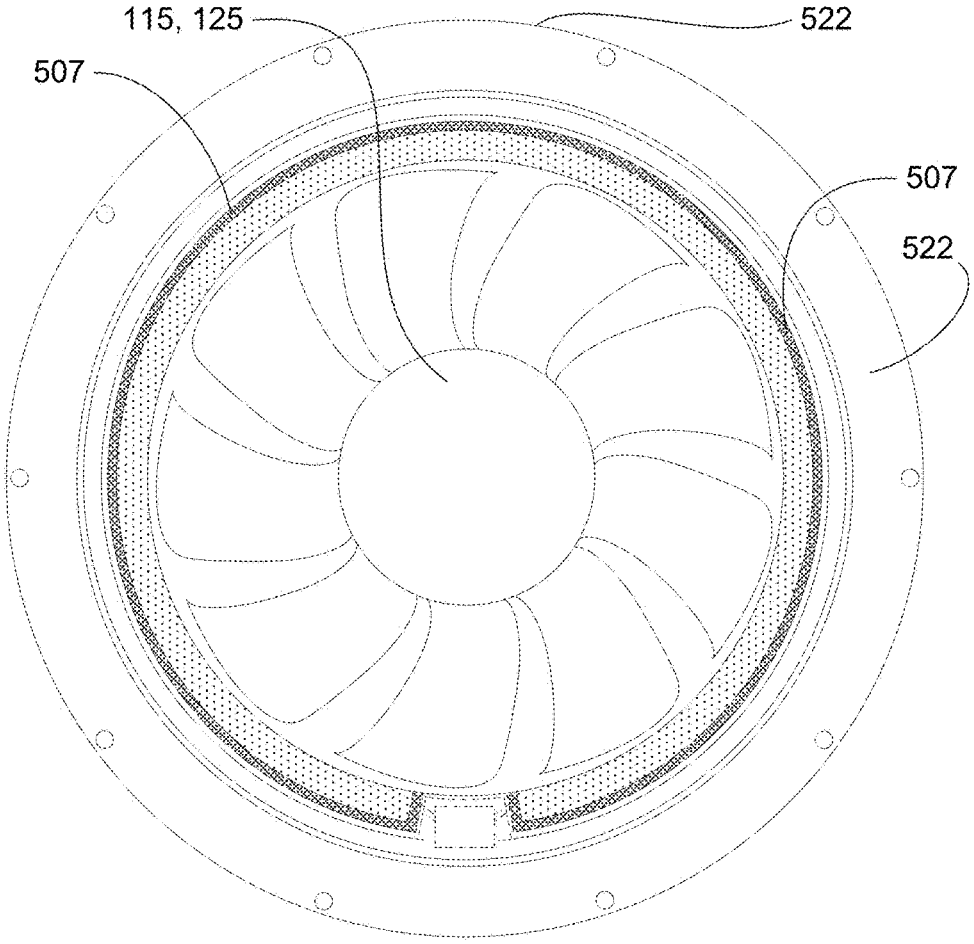
Figure 15C:
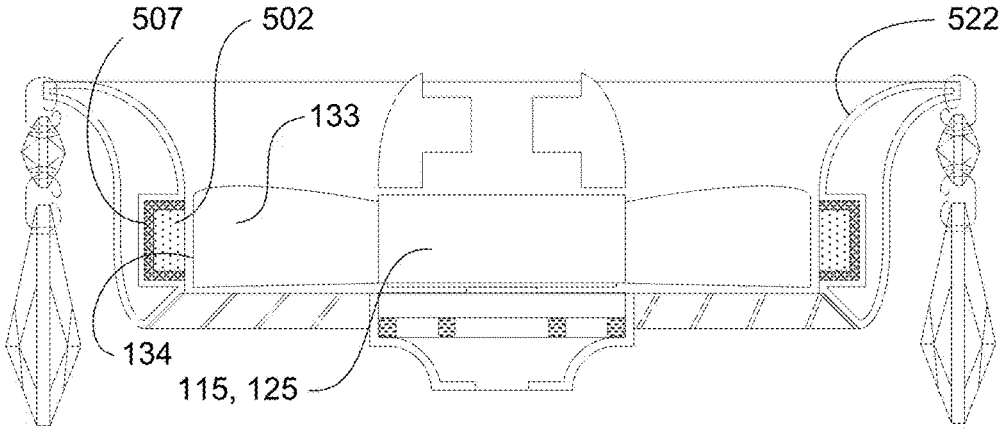

Referring now to FIGS. 15A-15D, air warming means 500 for optional heating of air moved through satellite units 110 and central fan unit 120 comprises annular electric heating coil 501 disposed within the perimeter of shroud 521, 522 just outside edge 134 of fans 115, 125 and coaxial, though not necessarily coplanar, with hub 131. FIG. 15A depicts coil 501 supported by supports 503 above shroud 521, while an alternate embodiment shown in FIG. 15C comprises coil 502 embedded within insulating material 507 and journaled within shroud 522 coaxial with fan 115, 125. Insulating material 507 minimizes any hazard of injury from heating shroud 522 in FIGS. 15C, 15D. One having ordinary skill in the art will recognize that alternate positioning of coils 501, 502, such as coaxially with hub 131 but smaller than and positioned above or below (not shown) fans 115, 125, may be achieved without departing from the spirit and scope of the present invention.

Electric power for coils 501, 502 would be provided by wiring (not shown) of appropriate size disposed along with power wiring for fans 115, 125 (if electrically driven) and preferably separately wired and controlled by a separate switch (not shown) either disposed conveniently within the room or mounted on fan chandeliers 100, 105 at an unobtrusive but convenient location within reach from beneath cental body 120. As an alternative, coils 501, 502 within each satellite units 110 could be separately controllable, necessitating location of a switch or rheostat (not shown) conveniently on satellite unit 110 itself, as discussed above for fans 115.

Heating means 500 is not limited to use with fan chandeliers 100, 105 having electrically driven fan motors 115, 125. Heating means 500 also can be used with satellites 210 of alternate embodiment 200 by simply including appropriate wiring (not shown) in arms 211 along with wiring 229 for lights 213.

Heating units 501 preferably comprise band heater strips typically made with NIC80 (80% nickel, 20% chromium) embedded in heat-conductive ceramic cases and shaped for the intended purpose. Preferably, heating units 501 would provide approximately 250 watts maximum each where fan chandeliers 100, 105 having six satellites 110, for a total of approximately 1500 watts, sufficient heating capacity to warm a reasonably sized room of 150 to 200 square feet in a matter of minutes. Suitable heating units 501 may be custom ordered as Duraband heaters from Tempco Electric Heater Corporation of Wood Dale, Ill.

Filtering

Figure 16A:
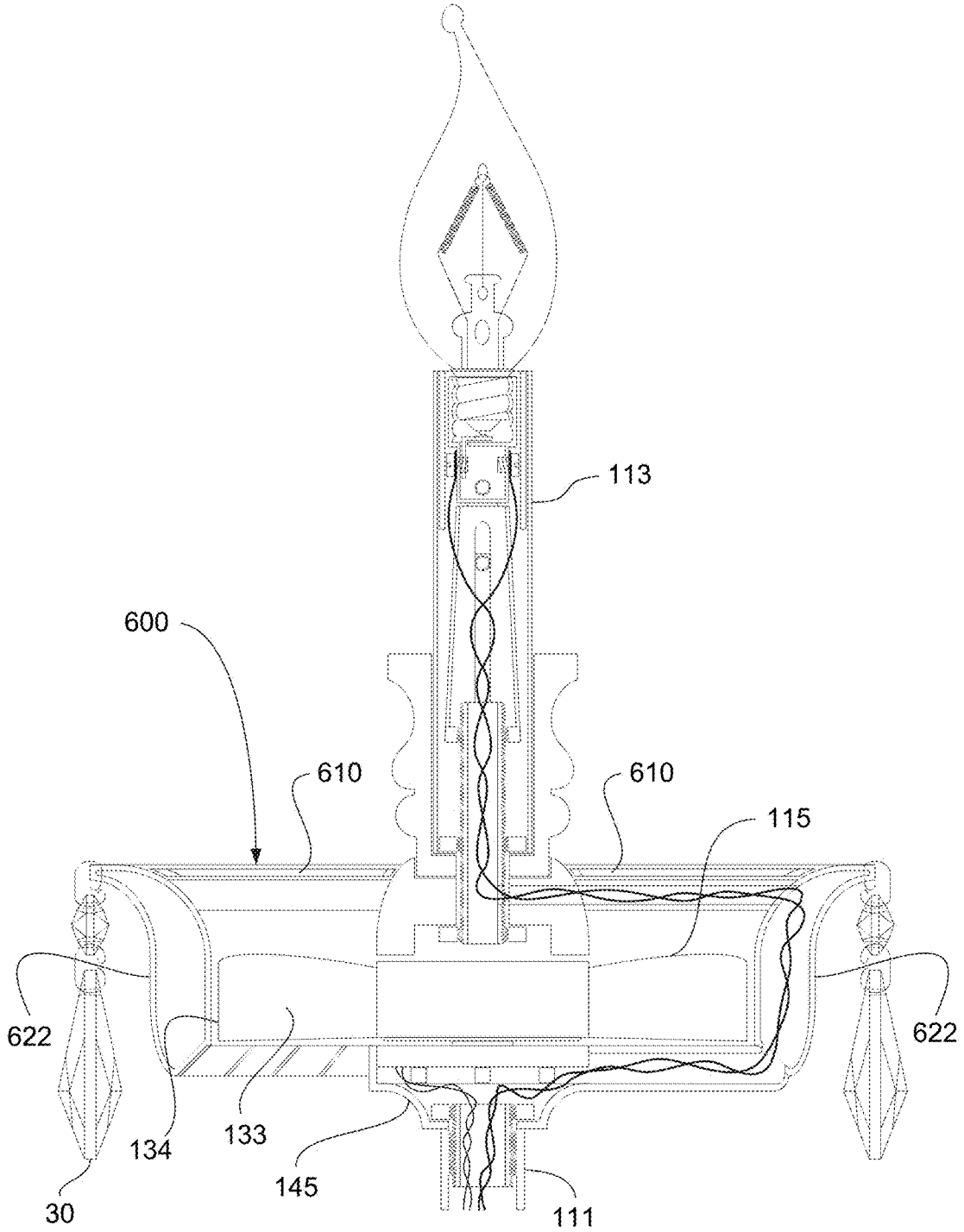
FIGS. 16A-16C detail means by which air may be filtered within the lighting units.
Figure 16B:
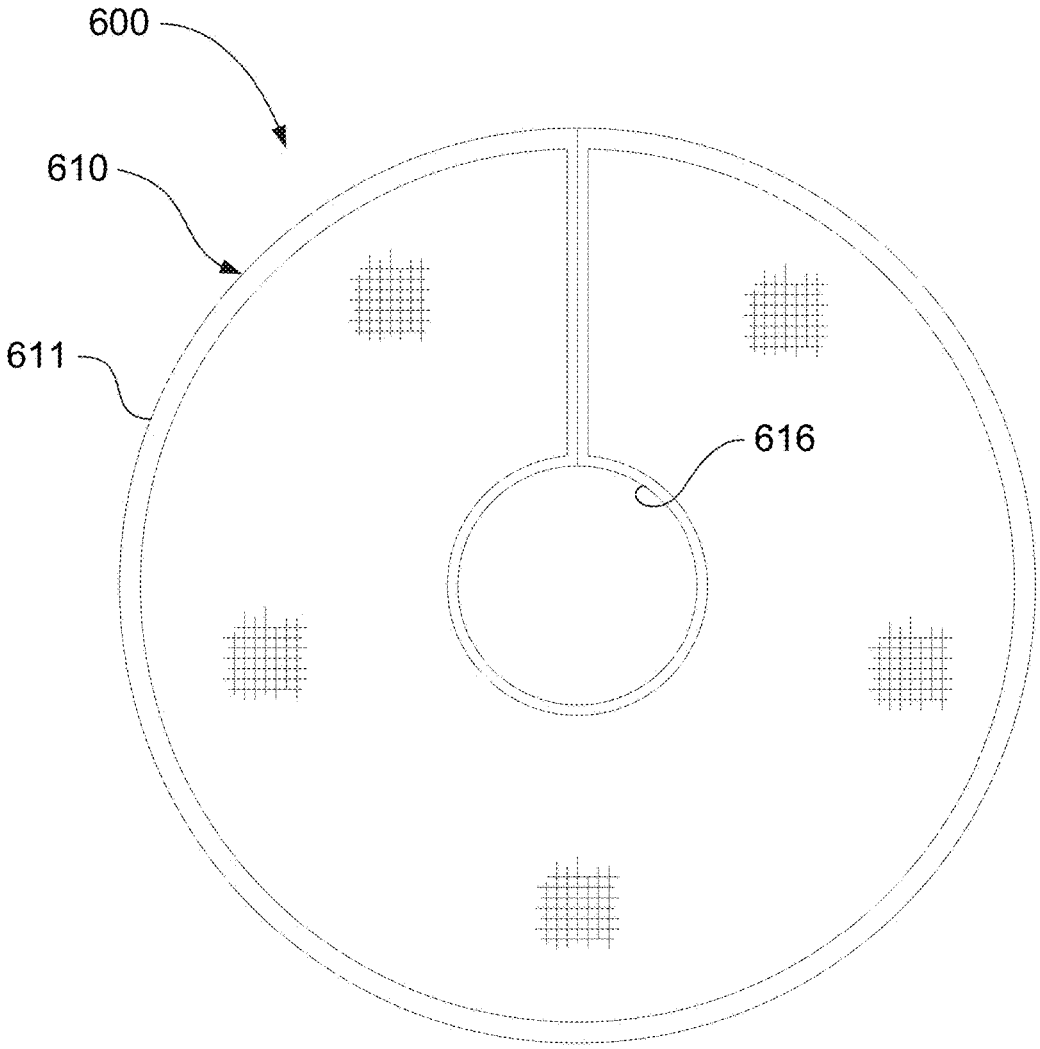
Figure 16C:
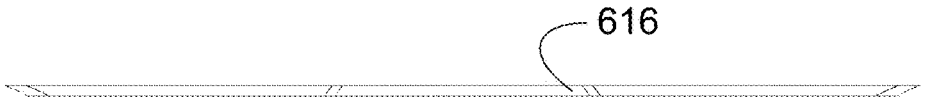

Referring now to FIGS. 16A-16C, filter means 600 for filtering air impelled by fan 615 comprises annular, planar bat of filter material 610 disposed coaxially with shroud 622 above fan 615. Shroud 622 engages at least a portion of the outer edge 611 of filter 610 to prevent its movement due to gravity or movement of air impelled by fan 615. As best seen in FIG. 16B, filter 610 comprises a substantially flat, fibrous disk having central aperture 616 adapted to surround light 113 and slit 618 which parts to admit filter 610 around light 113 without having to thread it over the end thereof. One having ordinary skill in the art will recognize that filter means 600 depicted in FIG. 16 for use in satellites 110, 210 also could be included into central fan unit 120 without departing from the spirit and scope of the present invention.

Filter means 600 may include activated carbon for air purification as well as for removal of odors and particulate matter from the air. A suitable carbon filter is available as Hunter 30901 from Alergy Be Gone of Brooklyn, N.Y.

Sconces

Figure 17:
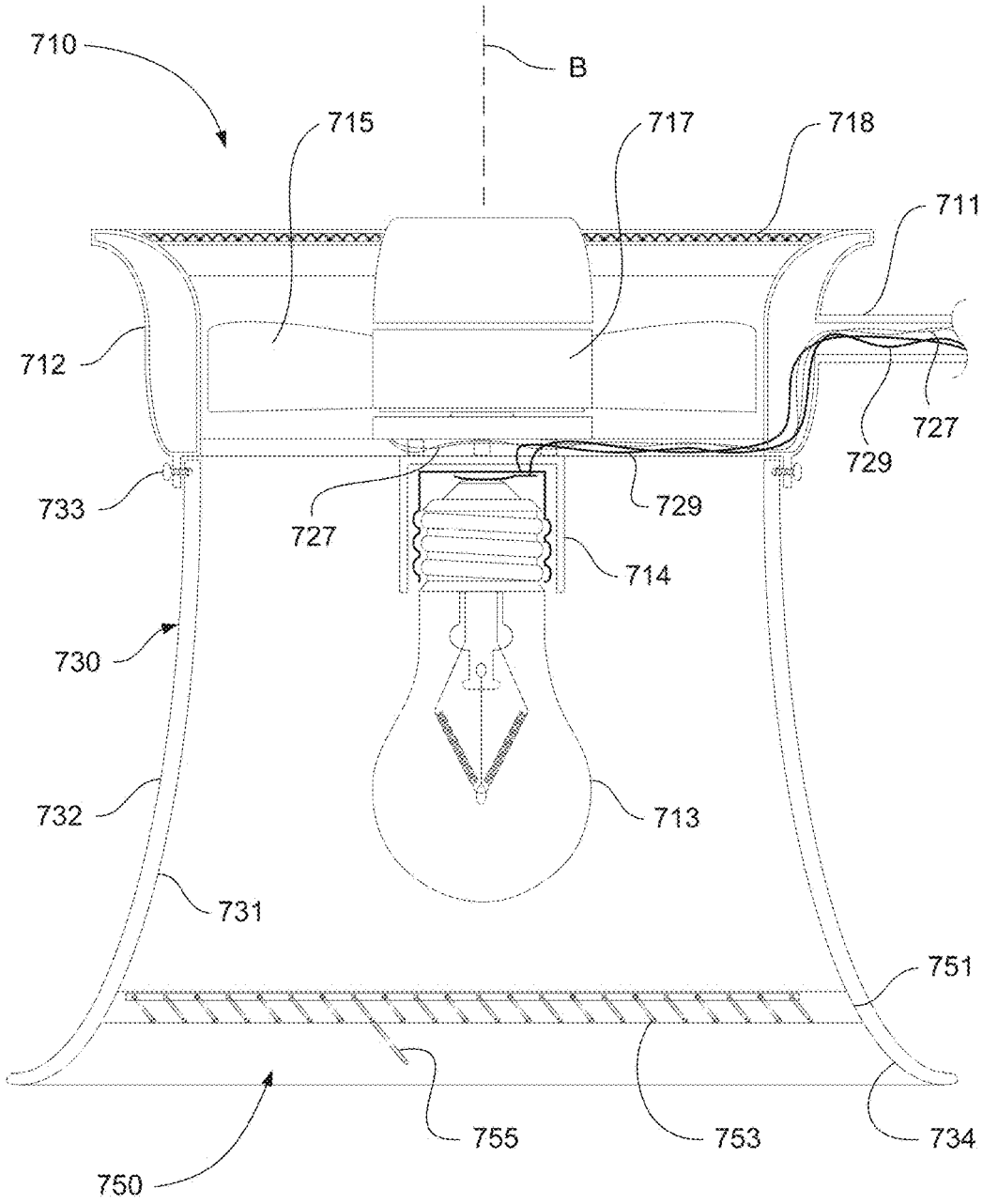
FIG. 17 show a single, shrouded fan light forming a sconce supported from a wall, the sconce having a downwardly extending globe surrounding a light, air from the fan passing entirely through the globe and across the light.
Figure 18:
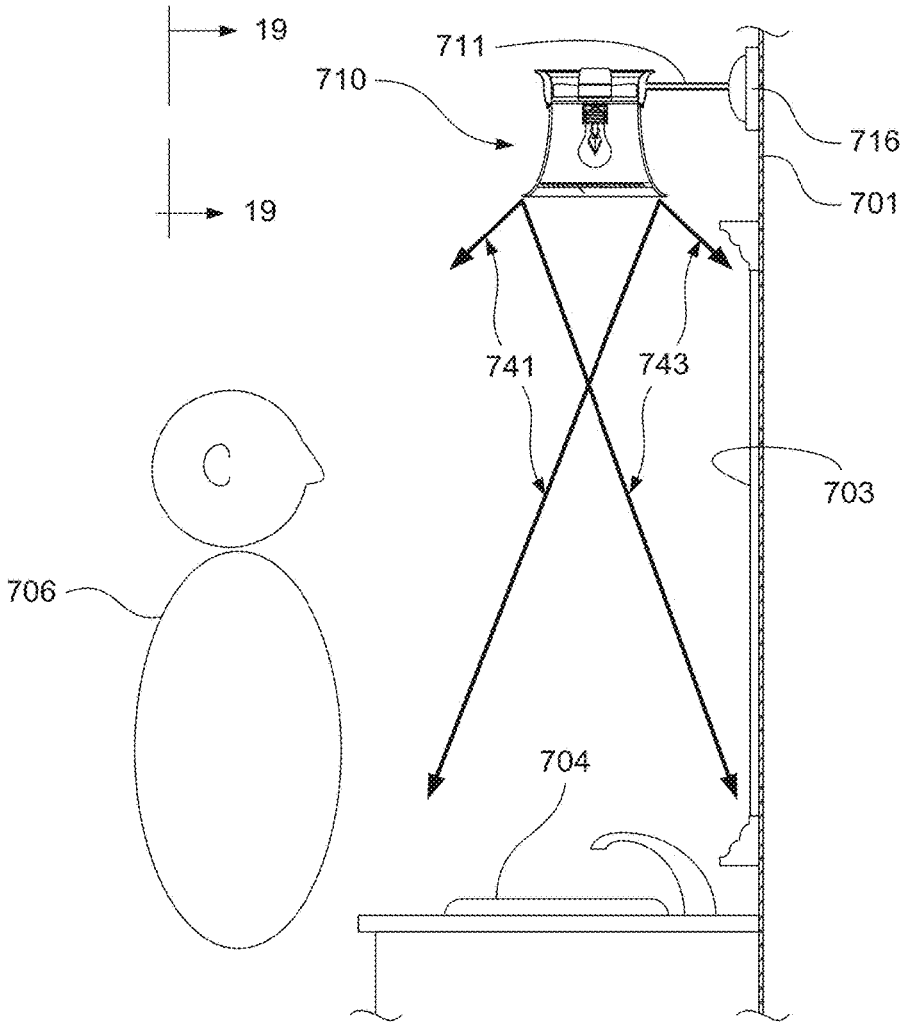
FIGS. 18-19 depict a typical application for the sconce of FIG. 17 in a bathroom.
Figure 19:
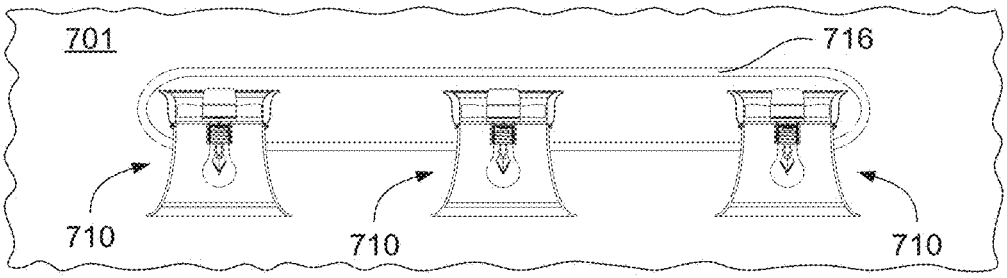

Turning now to FIGS. 17-19, sconce 710 includes housing 712 forming a shroud around fan 715, as in other embodiments of the present invention described above. In the case of sconce 710, however, housing 712 is supported by arm 711 extending from base 716 mounted directly to wall 701. Beneath and coaxial with motor 717 of fan 715, socket 714 supports light 713 depending in this case downward from housing 172 within interior 731 of globe 730. As described above for satellite units 110 in other embodiments, arm 711 also provides a conduit through which motor wiring 727 and light wiring 729 reach motor 717 and light 713 respectively from sconce base 716. Individual controls for motor 717 and light 713 may be provided in base 716 or on wall 701 (neither shown), as discussed above.

Globe 730 as shown comprises a truncated, substantial conical cylinder open at both ends and coupled to housing 712 at its proximate end by mounting 733 and flaring aesthetically at its opposite end distal fan 715 to form mouth 734. Globe 730 preferably completely surrounds light 713 and conceals (if opaque) or mutes (if translucent) light 713 from being directly viewed by user 706, thus reducing glare, e.g., on mirror 703. Preferably, globe 730 is made of a translucent material which diffuses illumination from light 713 to reduce glare but allows it to help illuminate the room.

Globe 730 also creates an interior channel 731 through which moves air impelled by fan 715, whether upward above fan 715 or downward through mouth 734 as determined by the direction of rotation of fan 715. Optional diffuser 750 is shown spanning across mouth 734 between diffuser mounts 751 coupled by known means to the interior surface 731 of globe 730. Diffuser 750 provides user 706 with means for directing air shadows 741, 743 toward user 706 (shadow 741) and/or toward mirror 703 (shadow 743), as illustrated in FIG. 18. One having ordinary skill in the art will recognize that any of the configurations for diffuser grates 170, 180, 190, 195, 198 discussed above could be employed within sconce 710, to effect a variety of air shadows (not shown) other than air shadows 741, 743, and that all possible configurations for diffuser 750 are considered to be within the spirit and scope of the present invention.

Figure 20:
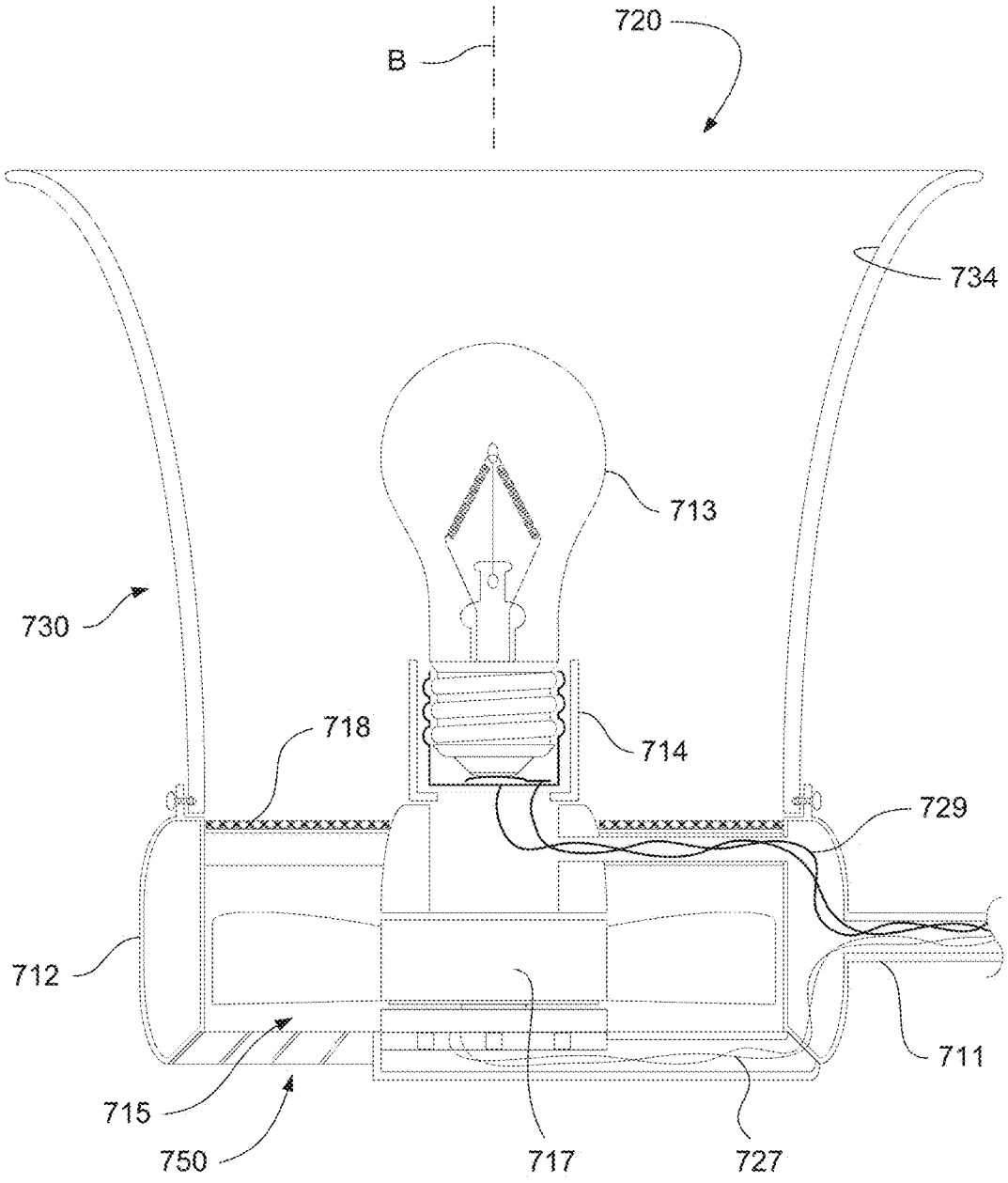
FIG. 20 depicts an alternate sconce similar to that shown in FIG. 17 but with its globe extending upward, and with other variations dictated by that arrangement.

As depicted in FIG. 20, alternate sconce 720 includes substantially all the features of sconce 710 except that its globe 730 extends upward from housing 712 instead of downward. This creates a few variations that bear discussion. First, diffuser 750 is not mounted within mouth 734 of globe 730, but instead spans housing 712 beneath fan 715. The primary benefit of diffuser 750 arises from user 706's ability to use it to direct air from fan 715 in a pattern substantially similar to that depicted in FIG. 18, regardless of which direction globe 730 extends. This motive dictates that diffuser 750 preferably is mounted below fan 715 for maximum effect. Second, filter 718 is mounted coaxial with socket 714 of light 713 but still above fan 715 to capture dust and other particles that fall into globe 730. Third, filter 718 preferably is opaque and provides a shading function to prevent illumination from light 713 from strobing in user 706's face.

Pendant Lights

Figure 21:
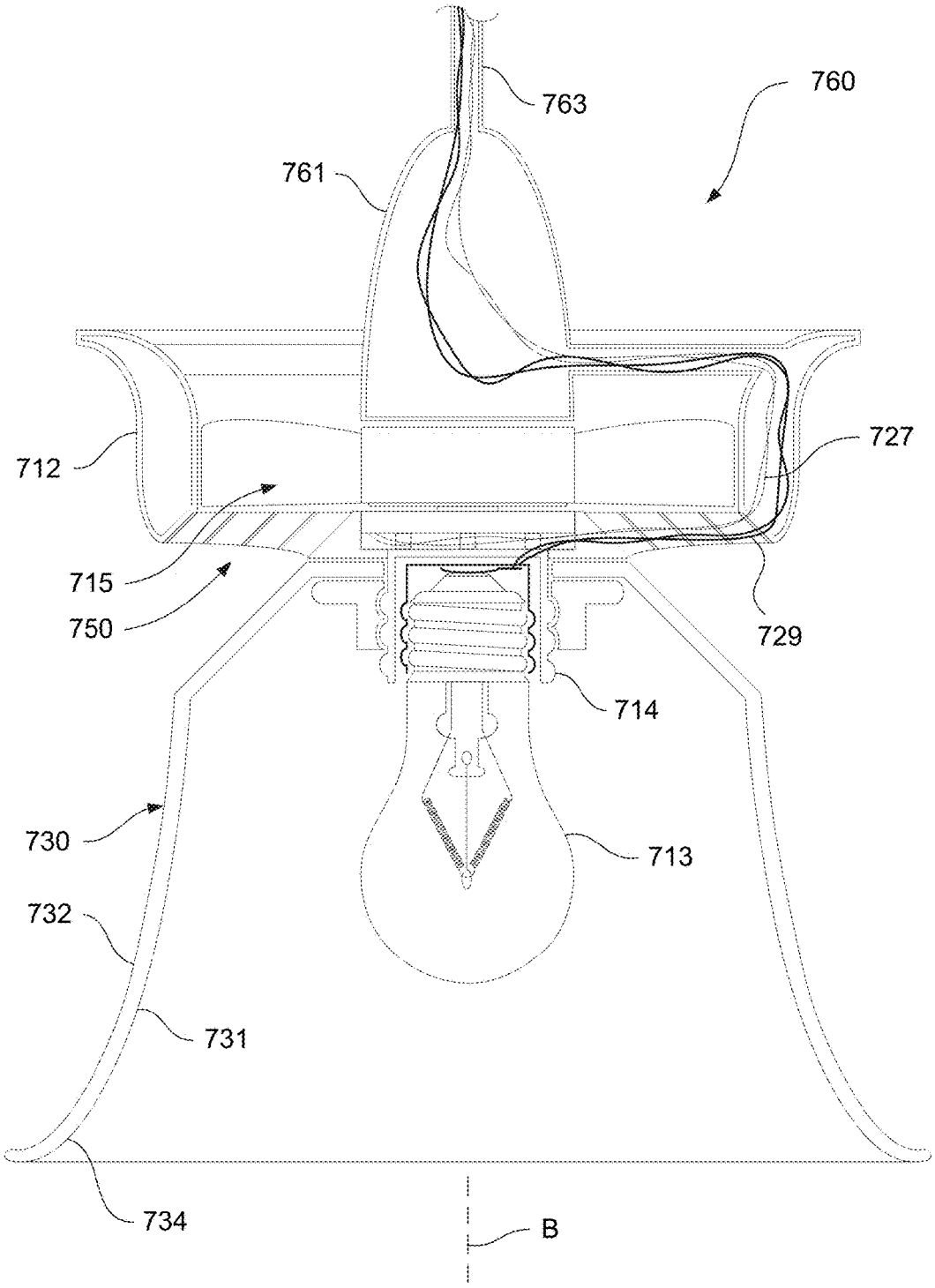
FIG. 21 shows a pendant light fan unit for use in lieu of pendant lights, the air from the fan passing outside the pendant globe.

Turning now also to FIG. 21, another embodiment of the present invention comprises pendant fixture 760 having fixture base 761 coaxial with and coupled directly to housing 712. Pendant fixture 760 is supported by vertically extending mast 763 suspended from ceiling mount 765 or other support (not shown). One having ordinary skill in the art will recognize that mast 763 could comprise a wire, cord, chain or metal tube or rod, or other vertically depending support as long as it disposes fixture base 761 and housing 712 a preferred distance below ceiling 5. Preferably, and as depicted in FIG. 21, mast 763 comprises a hollow tube through which motor wiring 727 and light wiring 1 729 may reach to pendant light 760 from ceiling 5, but one having ordinary skill in the art will recognize that all the mast 763 configurations mentioned above can convey wiring 727, 729, though only some of them can conceal wiring 727, 729 as depicted in FIG. 21.

As discussed for sconce 710, globe 730 couples beneath housing 712 and fan 715 and surrounds light 713 depending from housing 712 by socket 714. As depicted in FIG. 21, however, air from fan 715 does not flow through globe 730. Instead, it flows around exterior 732 of globe 730, while globe 730 provides partial diffusion thereof by forcing it away from vertical axis B. Separate diffuser 750 also may be provided beneath housing 712 to employ vanes 729 to better direct such air. Vanes 729 may or may not be adjustable, but one having ordinary skill in the art will recognize again that any of the configurations described for diffusers 170, 180, 190, 195, 198 discussed above may be employed for diffuser 750 without departing from the spirit and scope of the present invention.

Though depicted and discussed as a single light source and comprising but one housing 712 surrounding one fan 715, pendant light 760 could comprise one of several light fans 760 depending from a single mast 763, whether or not each is are disposed at the same elevation as the others below ceiling 5. See FIGS. 22A-22G One having ordinary skill in the art will recognize that any such arrays of pendant fan lights 760 is contemplated to fall within the spirit and scope of the present invention. One such array has been described above in great detail as fan chandeliers 100, 105, a specialized case where a plurality of rigid arms 111 each extends radially outward from mast 763 to hold one fan light 760.

Figure 22A:
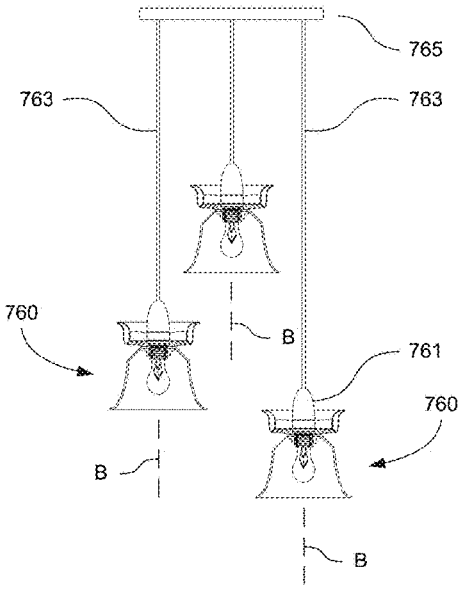
FIGS. 22A-22G depict various configurations for light fixtures employing the fan lights of the present invention.
Figure 22B:
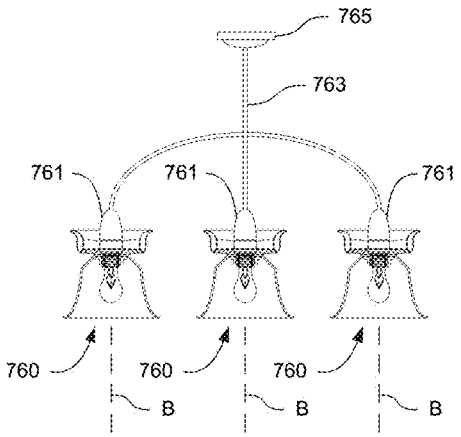
Figure 22C:
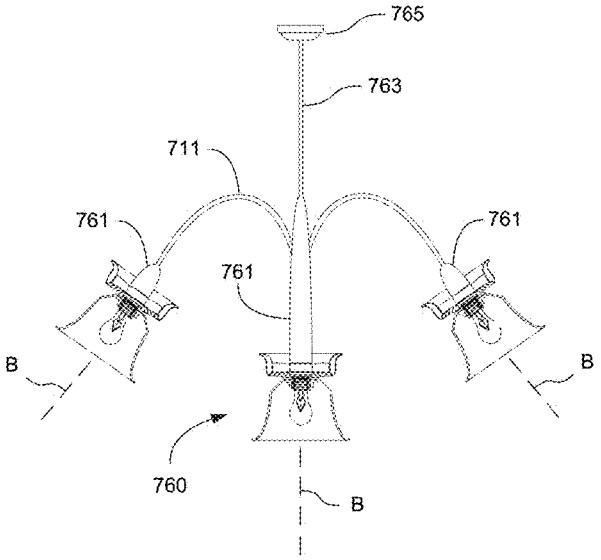
Figure 22D:
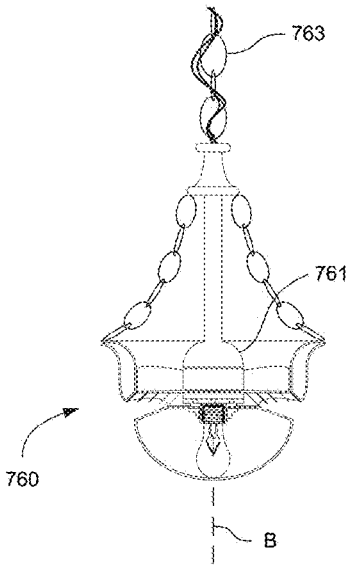
Figure 22E:
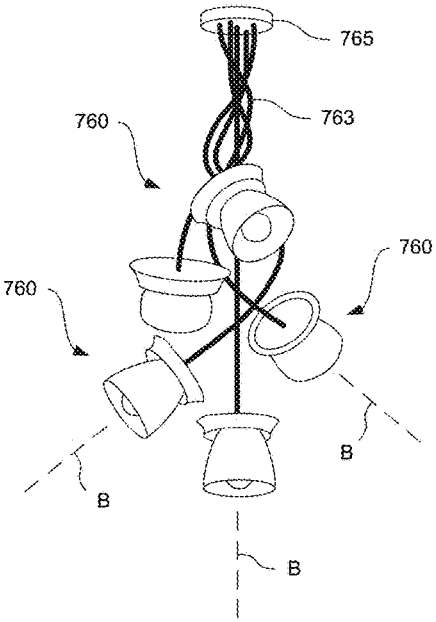
Figure 22F:
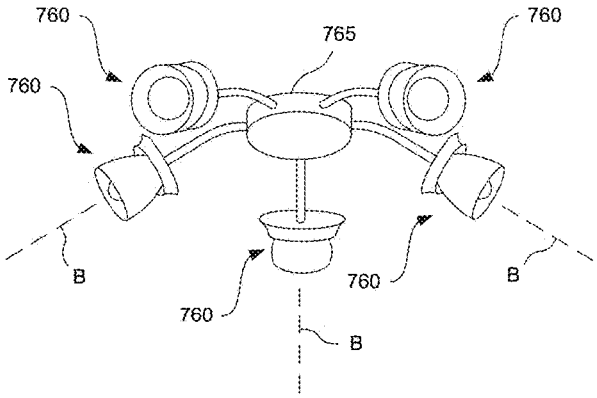
Figure 22G:
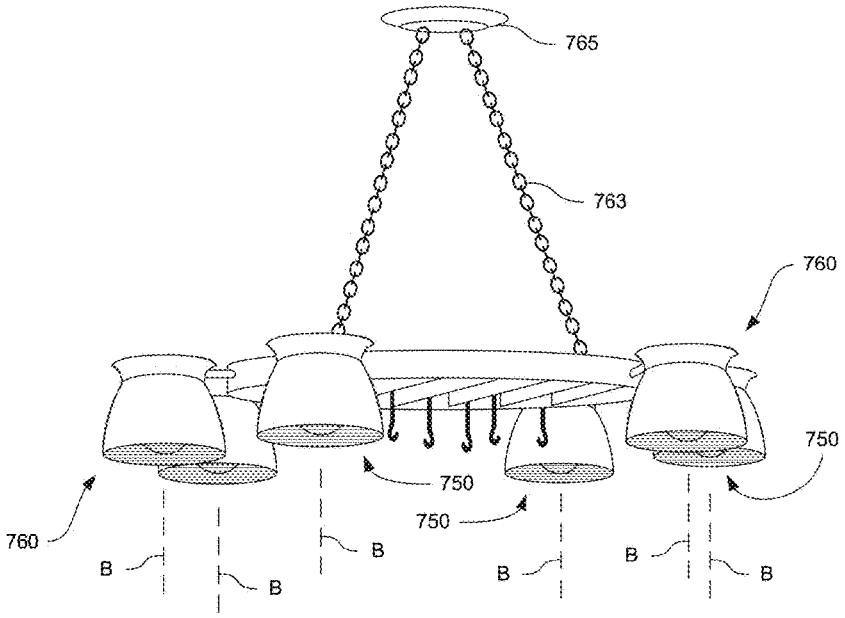

Still further, fan chandeliers 100, 105, sconces 710, 720 and pendant lights 760 all have been depicted and described as having axis B which is disposed substantially vertically, causing air from fan 715 to move substantially downward unless redirected by diffusers 750. One having ordinary skill in the art will recognize, however, that each fan chandelier satellite unit 110, sconce 710, 720 and pendant light 760 could have its axis B oriented at an angle to vertical (FIG. 22C). Where multiple such units are arrayed together, axis B for each unit could be oriented in a different direction (FIG. 22C) to optimize air and light flow patterns therefrom, whether or not diffusers 750 are employed further to fine tune said air flow.

Operation

In operation, fan chandeliers 100, 105 preferably are turned on using separate wall switches (not shown) for lights 113, fans 115, 125 and, when provided, heating means 500. Where such wall switches are simple on/off switches, the comfort of diners 6 in seats 3 may be regulated by turning on fan 125, fans 115 or both, with or without heating from heating means 500. Illumination to table 1 is provided by turning on lights 113.

Where rheostats such as switches 128 (FIG. 1) or wall switches (not shown) are provided, additional control is available. Specifically, illumination from lights 113 may be reduced to any level between full bright and off Rheostats for fans 115, 125 allow regulating the rpm's of fan 125 and of fans 115 (together) to vary the air flow within envelopes 164, 166 respectively. Rheostat control of heating means 500 may allow further refinement of the comfort of persons 6 seated at table 1. When the proper comfort level is achieved, no further adjustment is needed. Similarly, control switches (not shown) for fan chandeliers 200 may be operated separately to achieve optimum comfort and illumination.

Where sconces 710, 720 provide air flow in a specialized setting, such as over bathroom mirror 703, user 706 may adjust diffuser 750 to direct air at mirror 703 to keep it clear of condensation commonly a problem in bathrooms, especially after user 706 has bathed or showered. Diffuser 750 also could be directed toward user 706 to provide air to his face to dry it for shaving.

The present invention, described in either its preferred or alternate embodiments, thus serves the purpose of both a ceiling fan and a chandelier. Whereas a homeowner or other owner traditionally must choose between a handsome, showy chandelier or central air movement from a ceiling fan, fan chandeliers 100, 105, 200 provide an alternative where both are provided. Fancy chandeliers bearing many light refracting crystals 30 may grace the center of a room while fans concealed within the chandelier circulate air for optimal comfort, smoke and heat dispersal and other motives. Where air movement is not needed, the present invention provides a traditional chandelier. Where illumination is not needed, the present invention provides air movements as with any ceiling fan. Where both are needed, both are available.

While the invention has been particularly shown and described with reference to one or more embodiments, it will be understood by those skilled in the art that various changes in form and detail may be made therein without departing from the spirit and scope of the invention. For example, fans 115, 125, 215 largely have been discussed above as impelling air vertically downward toward table 1, they also may be designed for two-way operation, where air is drawn upward and impelled away from table 1. This maybe achieved by providing motors 117 which turn in the desired direction, or by affixing appropriately angled blades 133 to hub 131. Alternately, reversible-direction motors 117 may achieve reversible air flow in any of the devices discussed.

Further, the invention has been discussed as being used with table 1 where shadows 163, 165 are desirable traits. The present invention could be used in a more traditional ceiling fan situation where uniform dispersion of air is a more desirable outcome. This can be achieved by simply using diffusers 150 having broader air flow patterns, such as diffuser grate 198 having concentric vanes that distribute air in a 360 degree pattern.

The present invention also has been discussed above as having satellite units 110 bearing fans 115 and lights 113, whether or not central fan 125 also is included and coupled to central body 102. Instead, however, the present invention can comprise central body 102 bearing central fan 125 whether or not satellite units 110 also are present and disposed at the ends of arms 111, the latter being unnecessary if satellite units 110 are not included.

Finally, sconces 710, 720 and pendant lights 760 were discussed above without mention of any heating elements such as heaters 500, but they of course could be incorporated into housing 712 just as discussed above for other embodiments of the present invention.

CHART A

| | General Options | Examples/Catalog # |
|---|---|---|
| Motor Placement | Multiple motors integrated in fans (i.e. case fans, computer fans, etc.) | NMB-MAT 4715FS-12T-B50-D00 Case Fan - Satellite Units (AC)<br>NMB-MAT 5915PC-12T-B20-A00 - Center Unit (AC)<br>NMB-MAT 4710KL-05W-B50 - Satellite Units (DC Option)<br>NMB-MAT 682PL-05W-B70 - Center Unit (DC Option) |
| | Single motor integrated in fixture | 1/8 HP PSC High Efficiency Ring/Stud Mount Blower Motor, 3 Speed, 1075 Max RPM, Grainger Stock # 4UY17 with a 1:2.8 Gearbox |
| | Single motor remotely mounted outside fixture (against ceiling, in attic, etc.) | Motor from MinkaAire, Mystique, Model No. F611, 3 Speed (65, 107, and 163 RPM) with a 1:18.4 Gearbox |
| | Multiple motors integrated in fixture | Uncased Small Fan Motor, 1/70 HP, 3000 RPM Grainger Item Number 3M566 |
| | Combination of above options | |
| Fan Placement | Satellite Fans (located at the lights) | |
| | Center Fan (located in the main body of the fixture) | |
| | Combination of above options | |
| Fan Type | Axial or Propeller Fan | NMB-MAT 4715FS-12T-B50-D00 Case Fan - Light Units (AC)<br>NMB-MAT 5915PC-12T-B20-A00 - Center Fan Unit (AC)<br>NMB-MAT 4710KL-05W-B50 - Satellite Units (DC Option)<br>NMB-MAT 682PL-05W-B70 - Center Unit (DC Option)<br>PM Motor Fan Blade Co., Part # 4LHF.250-W<br>Air-Drive, Inc., 10 Wing Fan, Part # AD10-5.00-CC-B-37-0.25 |
| | Centrifugal (Radial) Fan | Air-Drive, Inc., Bi-Directional, 12 Petals, Radial Blade, Part # AD-4.75-CC-B-90-0.25 or<br>Air-Drive, Inc., 8 Petals, Radial Blade, Part # AD-6.25-CC-B-90-0.25 |
| | Mixed Flow Fan | |
| | Combination of the above options | |
| Diffuser Optional (Design Dependent) | Slats at Different Angles, Louvers, Grills, etc. (Internal/External) | |
| | Cone (Straight, Elliptical, etc.) | |
| | None or Combination of the above options | |
| Bevel Gear Optional (Design Dependent) | Solid Shaft | S.S. White Technologies, Ratio Drive, Gear Ration 1:1, Right Angle, Light Duty, Part # FG118V |
| | Hollow Core to allow electrical wiring through shaft | |
| Flexible Cable Optional (Design Dependent) | Solid Shaft | S.S. White Technologies, Steady-Flex, Bi-Directional Flexible Shaft, Part # FR130SLPCC01800 |
| | Hollow Core to allow electrical wiring through shaft | Suhner Manufacturing Inc., Hollow Center Core Flexible Shaft, Part # A-250-4143 |
| Crystals Optional (Design Dependent) | Normal Mounting - strategically placed out of the airstream | |
| | Single Point Rigidly Mounted | Compression Fitting, Hook Fitting, Slot Fitting, Slide Fitting, or Screw Fitting |
| Filter Optional (Design Dependent) | Dust Collection<br>Oder Elimination | Filter Material - Hunter 30901 from Alergy Be Gone of Brooklyn, New York |

CHART A-continued

| | General Options | Examples/Catalog # |
|---|---|---|
| Heater | Heater Band along sides | Duraband Heaters from Tempco Electric Heater Corporation of Wood Dale, Illinios |
| Optional (Design Dependent) | Heater Bands above Fan | |

I claim:

1. A light fixture comprising:

a first body, the first body including a mounting bracket for attaching the light fixture to another object;

a second body, the second body including an internal fan for producing an air stream, the fan having an axis of rotation, a light socket configured for coupling with a light source, such that the light socket and the light source are located along the axis of rotation when the light source is operably coupled with the light socket, and such that the light socket supports and provides electrical power to the light source when the light source is operably coupled with the light socket, a fan shroud member coupled to the fan and the light socket, the fan shroud member being coaxial with the axis of rotation and the fan shroud member extending circumferentially about the axis of rotation and around the fan, such that at least part of the fan is concealed by the fan shroud member but the fan shroud member does not conceal the light source when the light source is operably coupled with the light socket, and an outlet diffuser coupled to an outlet side of the fan shroud member, the outlet diffuser having numerous guide vanes, such that the outlet diffuser, the fan shroud member, and the internal fan are configured so that during operation of the internal fan when the light fixture is operably installed in a room, (i) the air stream generated by the internal fan exits the outlet side of the fan shroud member along the axis of rotation while entering the outlet diffuser, and (ii) the air stream is divided and segments of the air stream are redirected according to a respective angle of each of the guide vanes toward a targeted area in the room and outside of the light fixture, wherein the targeted area is limited to a partial region of the room; and a first arm extending between and coupling the first body to the second body, such that the second body is supported by the first body via the first arm.

2. The light fixture of claim 1, wherein the first arm has a curved shape.

3. The light fixture of claim 1, wherein the first arm extends generally horizontally when the light fixture is operably attached to another object.

4. The light fixture of claim 1, wherein the first arm is located above the fan and the fan is located between the light socket and the first arm.

5. The light fixture of claim 1, wherein the first arm is located below the fan and the fan is located between the light socket and the first arm.

6. The light fixture of claim 1, wherein the first arm is located horizontally adjacent to the fan, and the fan shroud member is located between the fan and the first arm.

7. The light fixture of claim 1, further comprising:

a light globe coupled to the light socket, such that the light globe extends circumferentially about the axis of rotation and around the light source when the light source is operably coupled with the light socket.

8. The light fixture of claim 1, wherein the diffuser is generally disc-shaped.

9. The light fixture of claim 1, wherein at least one of the guide vanes is moveable.

10. The light fixture of claim 1, wherein the diffuser is removably coupled to the fan shroud member.

11. The light fixture of claim 1, wherein the diffuser is located between the fan and the light socket.

12. The light fixture of claim 1, wherein the fan is located between the diffuser and the light socket.

13. The light fixture of claim 1, wherein the light fixture has a chandelier light configuration.

14. The light fixture of claim 1, wherein the light fixture has a pendant light configuration.

15. The light fixture of claim 1, wherein the light fixture has a track light configuration.

16. The light fixture of claim 1, wherein the light fixture has a sconce light configuration.

17. The light fixture of claim 1, comprising multiple internal fans, each of the internal fans being individually controllable for fan speed.

18. The light fixture of claim 1, wherein the second body further comprises a light globe located along the axis of rotation, the light globe having a distal open mouth portion, such that the air stream is channeled at least partially through the light globe during operation of the fan.

19. The light fixture of claim 1, wherein the diffuser is generally disc-shaped.

20. The light fixture of claim 1, wherein each of the guide vanes has a generally flat planar shape.

21. A light fixture comprising:

a fan for producing an air stream, the fan having an axis of rotation; a light socket located along the axis of rotation;

a fan shroud member being coaxial with the axis of rotation and extending circumferentially about the axis of rotation and around the fan, such that at least part of the fan is concealed by the fan shroud member but the fan shroud member is not concealing at least part of the light socket; and an outlet diffuser coupled to an outlet side of the fan shroud member, the outlet diffuser having numerous guide vanes, such that the outlet diffuser, the fan shroud member, and the internal fan are configured so that during operation of the internal fan when the light fixture is operably installed in a room, (i) the air stream generated by the internal fan exits the outlet side of the fan shroud member along the axis of rotation while entering the outlet diffuser, and (ii) the air stream is divided and segments of the air stream are redirected according to a respective angle of each of the guide vanes toward a targeted area in the room and outside of the light fixture, wherein the targeted area is limited to a partial region of the room.

22. The light fixture of claim 21, wherein at least one of the guide vanes is moveable.

23. The light fixture of claim 21, wherein the diffuser is removably coupled to the fan shroud member.

24. The light fixture of claim 21, wherein the diffuser is located between the fan and the light socket.

25. The light fixture of claim 21, wherein the fan is located between the diffuser and the light socket.

26. The light fixture of claim 21, wherein the diffuser is generally disc-shaped.

27. The light fixture of claim 21, wherein each of the guide vanes has a generally flat planar shape.

28. A light fixture comprising:

a first body, the first body including a mounting bracket; a second body, the second body including a fan located within the second body for producing an air stream, the fan having an axis of rotation, a light socket located along the axis of rotation, a fan shroud member being coaxial with the axis of rotation and extending circumferentially about the axis of rotation and around the fan, such that at least part of the fan is concealed by the fan shroud member, and an outlet diffuser coupled to the fan shroud member, wherein the outlet diffuser is generally disc-shaped;

the outlet diffuser having numerous guide vanes, such that the outlet diffuser, the fan shroud member, and the fan are configured so that during operation of the fan when the light fixture is operably installed in a room, (i) the air stream generated by the fan exits the fan shroud member while entering the outlet diffuser, and (ii) the air stream is redirected by the guide vanes toward a targeted area in the room and outside of the light fixture, wherein the targeted area is limited to a partial region of the room: and a first arm extending between and coupling the first body to the second body, such that the second body is supported by the first body via the first arm.

29. The light fixture of claim 28, wherein the diffuser is located between the fan and the light socket.

30. The light fixture of claim 28, wherein the fan is located between the diffuser and the light socket.

31. The light fixture of claim 28, wherein the fan shroud member does not conceal at least part of the light socket.

32. The light fixture of claim 28, wherein the guide vanes causes the air stream to be divided and segments of the air stream are redirected according to a respective angle of each of the guide vanes when the air stream exits the fan shroud member via the diffuser.

33. The light fixture of claim 28, wherein each of the guide vanes has a generally flat planar shape.

* * * * *